US006600824B1

(12) United States Patent
Matsuo

(10) Patent No.: US 6,600,824 B1
(45) Date of Patent: Jul. 29, 2003

(54) MICROPHONE ARRAY SYSTEM

(75) Inventor: Naoshi Matsuo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 330 days.

(21) Appl. No.: 09/625,968

(22) Filed: Jul. 26, 2000

(30) Foreign Application Priority Data

Aug. 3, 1999 (JP) ..... 11-220300

(51) Int. Cl.[7] ..... H04R 3/00
(52) U.S. Cl. ..... 381/92; 381/122
(58) Field of Search ..... 381/91, 92, 122, 381/111, 113, 356

(56) References Cited

U.S. PATENT DOCUMENTS

| | | | | |
|---|---|---|---|---|
| 4,412,097 A | * | 10/1983 | Ishigaki et al. | 381/92 |
| 5,471,538 A | * | 11/1995 | Sasaki et al. | 381/92 |
| 5,473,701 A | * | 12/1995 | Cezanne et al. | 381/92 |
| 5,477,270 A | * | 12/1995 | Park | 381/92 |
| 5,581,495 A | * | 12/1996 | Adkins et al. | 381/92 |
| 5,600,727 A | * | 2/1997 | Sibbald et al. | 381/26 |
| 5,657,393 A | * | 8/1997 | Crow | 381/92 |
| 5,825,898 A | * | 10/1998 | Marash | 381/92 |
| 5,933,506 A | * | 8/1999 | Aoki et al. | 381/122 |
| 6,069,961 A | * | 5/2000 | Nakazawa | 381/92 |
| 6,317,501 B1 | * | 11/2001 | Matsuo | 381/92 |

FOREIGN PATENT DOCUMENTS

| | | |
|---|---|---|
| EP | 0 414 264 | 2/1991 |
| EP | 0 700 156 | 3/1996 |
| JP | 6-98390 | 4/1994 |
| JP | 9-238394 | 9/1997 |

OTHER PUBLICATIONS

Matsuo et al., "Speaker Position Detection System Using Audio–visual Information", Fujitsu Study Report, vol. 35, No. 2 (10 pages).

Copy of Dutch Patent Office Communication and Search Report for corresponding Dutch Patent Application 1015839 dated Nov. 27, 2002.

* cited by examiner

*Primary Examiner*—Xu Mei
(74) *Attorney, Agent, or Firm*—Armstrong, Westerman & Hattori, LLP

(57) ABSTRACT

A microphone array system includes two microphones that are arranged in an axis direction and a sound signal estimation processing part. The sound signal estimation processing part expresses an estimated sound signal to be received in a position on the straight line on which the two microphones are arranged by a wave equation Equation 1, assuming that a sound wave coming from a sound source to the two microphones is a plane wave. The sound signal estimation processing part estimates a coefficient b cos θ that depends on a direction from which a sound wave of the wave equation Equation 1 comes, assuming that an average power of the sound wave that reaches each of the two microphones is equal to that of the other microphone. The sound signal estimation processing part estimates a sound signal to be received in an arbitrary position on the same axis on which the microphones are arranged, based on sound signals received by the two microphones.

27 Claims, 17 Drawing Sheets

MICROPHONE ARRAY SYSTEM

BACKGROUND OF THE INVENTION

1. Field of the Invention

The present invention relates to a microphone array system. In particular, the present invention relates to a system including two microphones arranged on one coordinate axis that estimates a sound to be received in an arbitrary position on that dimensional axis by performing received sound signal processing and thus can estimate sounds in numerous positions with a small number of microphones.

2. Description of the Related Art

Hereinafter, a sound-estimation processing technique utilizing a conventional microphone array system will be described.

A microphone array system includes a plurality of microphones, and performs signal processing by utilizing sound signals received at each microphone. The objectives, the structures, the use and the effects of the microphone array system are varied significantly by how microphones are arranged in the sound field, what kind of sounds are received, and what kind of signal processing is performed. In the case where there are a plurality of sound sources of desired sounds and noise in the sound field, enhancing the desired sounds and suppressing noise with high quality are main tasks to be achieved by received sound processing with microphones. Detection of the positions of the sound sources is useful for various applications such as teleconference systems, guest-reception systems or the like. In order to realize processing for enhancing a desired sound, suppressing noise and detecting the position of a sound source, it is useful to use the microphone array system.

In the conventional technique, in order to improve quality in enhancing a desired sound, suppressing noise and detecting the position of the sound source, signal processing is performed with an increased number of microphones constituting the array in order to obtain more data of received sound signals. FIG. 17 shows a microphone array system used for desired sound enhancement processing by conventional synchronous addition. In the microphone array system shown in FIG. 17, reference numeral 171 denotes real microphones $MIC_0$ to $MIC_{n-1}$ constituting a microphone array, reference numeral 172 denotes delay units $D_0$ to $D_{n-1}$ for adjusting timing of the signals of the sounds received by the microphones 171, and reference numeral 173 denotes an adder for adding the signals of the sounds received by the microphones 171. In the desired sound enhancement by the conventional technique, a sound from a specific direction is enhanced by adding the numerous components wherein the received sound signals which become components for the addition processing are delayed for synchronization. In other words, sound signals used for the synchronous addition signal processing are increased in number by increasing the number of the real microphones 171. Thus, the intensity of the desired sound is increased. In this manner, the desired sound is enhanced so that a distinct sound is picked out. In noise suppression processing, noise is suppressed by performing synchronous subtraction. In processing for detecting the position of a sound source, synchronous addition or calculation of cross-correlation coefficients is performed with respect to an assumed direction. Thus, in these cases as well, sound signal processing is improved by increasing the number of microphones.

However, this technique for microphone array signal processing that can be improved by increasing the number of microphones is disadvantageous in that a large number of microphones are required to be prepared to realize high quality sound signal processing, and therefore the microphone array system results in a large scale. Moreover, in some cases, it may be difficult to physically arrange a necessary number of microphones for sound signal estimation with required quality in a necessary position.

In order to solve the above problems, it is desired to estimate a sound signal that would be received in an assumed position based on actual sound signals received by actually arranged microphones, instead of receiving a sound by a microphone that is arranged actually. Furthermore, using the estimated signals, enhancement of a desired sound, noise suppression and detection of a sound source position can be performed.

The microphone array system is useful in that it can estimate a sound signal to be received in an arbitrary position on an array arrangement, using a small number of microphones. The microphone array system estimates a sound signal to be received in an assumed position on the extension line (one-dimension) of a straight line on which a small number of microphones are arranged. Although actual sounds propagate in a three-dimensional space, if a sound signal to be received in an arbitrary position on one axis direction can be estimated, a sound signal to be received in an arbitrary position in a space can be obtained by estimating and synthesizing sound signals to be received in the coordinate positions on the three axes in the space, based on the estimated sound signal to be received in the position on each axis. The microphone array system is required to estimate a signal from a sound source with reduced estimation errors and high quality.

Furthermore, it is desired to develop an improved signal processing technique for signal processing procedures used for the sound signal estimation so as to improve the quality of the enhancement of a desired sound, the noise suppression, the sound source position detection.

SUMMARY OF THE INVENTION

It is an object of the present invention to provide a first microphone array system that can estimate a signal to be received in an arbitrary position on an axis by arranging two microphones on the axis.

It is another object of the present invention to provide a second microphone array system that can estimate a signal to be received in an arbitrary position on a plane by arranging three microphones on the plane.

It is another object of the present invention to provide a third microphone array system that can estimate a signal to be received in an arbitrary position in a space by arranging four microphones in the space in such a manner that they are not on the same plane.

In order to achieve the above objects, the first microphone array system of the present invention includes two microphones and a sound signal estimation processing part, and estimates a sound signal to be received in an arbitrary position on a straight line on which the two microphones are arranged. The sound signal estimation processing part expresses a sound signal estimated to be received in a position on the straight line on which the two microphones are arranged by a wave equation Equation 5, assuming that the sound wave coming from a sound source to the two microphones is a plane wave. The sound signal estimation processing part estimates a coefficient b cos θ of the wave equation Equation 5 that depends on the direction from which the sound wave comes, assuming that the average power of the sound wave that reaches each of the two microphones is equal to that of the other microphone. The sound signal estimation processing part estimates a sound signal to be received in an arbitrary position on the same axis on which the microphones are arranged, based on the sound signals received by the two microphones.

$$P(x_{i+1}, y_0, t_j) - P(x_i, y_0, t_j) = a\{v_x(x_i, y_0, t_{j+1}) - v_x(x_i, y_0, t_j)\} \quad \text{Equation 5}$$

$$\{v_x(x_{i+1}, y_0, t_j) - v_x(x_i, y_0, t_j)\} = b\cos\theta\{p(x_{i+1}, y_0, t_j) - p(x_{i+1}, y_0, t_{j-1})\}$$

where x and y are respective spatial axes, t is a time, v is an air particle velocity, p is a sound pressure, a and b are coefficients, and θ is the direction of a sound source.

By the above embodiment, a sound signal to be received in an arbitrary position on the same axis can be estimated with Equation 5 by estimating a term of b cos θ, regarding the average powers of the sound wave received by the two microphones as equal under the condition in which the sound wave coming from the sound source in an arbitrary direction θ to the two microphones can be regarded as a plane wave. Estimation is possible with a small number of microphones of 2, and thus it is possible to reduce the system scale.

In order to achieve the above objects, the second microphone array system of the present invention includes three microphones that are not on a same straight line and a sound signal estimation processing part, and estimates a sound signal to be received in an arbitrary position on the same plane on which the three microphones are arranged. The sound signal estimation processing part expresses a sound signal estimated to be received in a position on the same plane on which the three microphones are arranged by a wave equation Equation 6, assuming that the sound wave coming from a sound source to the three microphones is a plane wave. The sound signal estimation processing part estimates coefficients b cos $\theta_x$ and b cos $\theta_y$ of the wave equation Equation 6 that depend on the direction from which the sound wave comes, assuming that the average power of the sound wave that reaches each of the three microphones is equal to those of the other microphones. The sound signal estimation processing part estimates a sound signal to be received in an arbitrary position on the same plane on which the microphones are arranged, based on the sound signals received by the three microphones.

$$P(x_{i+1}, y_0, t_j) - P(x_i, y_0, t_j) = a\{v_x(x_i, y_0, t_{j+1}) - v_x(x_i, y_0, t_j)\} \quad \text{Equation 6}$$

$$\{v_x(x_{i+1}, y_0, t_j) - v_x(x_i, y_0, t_j)\} = b\cos\theta_x\{p(x_{i+1}, y_0, t_j) - p(x_{i+1}, y_0, t_{j-1})\}$$

$$P(x_0, y_{S+1}, t_j) - P(x_0, y_S, t_j) = a\{v_y(x_0, y_S, t_{j+1}) - v_y(x_0, y_S, t_j)\}$$

$$\{v_y(x_0, y_{S+1}, t_j) - v_y(x_0, y_S, t_j)\} = b\cos\theta_y\{p(x_0, y_{S+1}, t_j) - p(x_0, y_{S+1}, t_{j-1})\}$$

By the above embodiment, a sound signal to be received in an arbitrary position on the same plane can be estimated with Equation 6 by estimating terms of b cos $\theta_x$ and b cos $\theta_y$, regarding the average powers of the sound wave received by the three microphones as equal under the condition in which the sound wave coming from the sound sources in arbitrary directions $\theta_x$ and $\theta_y$ to the three microphones can be regarded as a plane wave. Estimation is possible with a small number of microphones of 3, and thus it is possible to reduce the system scale.

In order to achieve the above objects, the third microphone array system of the present invention includes four microphones that are not on the same plane and a sound signal estimation processing part, and estimates a sound signal to be received in an arbitrary position in a space. The sound signal estimation processing part expresses a sound signal estimated to be received in an arbitrary position in the space by a wave equation Equation 7, assuming that the sound wave coming from a sound source to the four microphones is a plane wave. The sound signal estimation processing part estimates coefficients b cos $\theta_x$, b cos $\theta_y$ and b cos $\theta_z$ of the wave equation Equation 7 that depend on the direction from which the sound wave comes, assuming that the average power of the sound wave that reaches each of the four microphones is equal to those of the other microphones. The sound signal estimation processing part estimates a sound signal to be received in an arbitrary position in the space in which the microphones are arranged, based on the sound signals received by the four microphones.

$$P(x_{i+1}, y_0, z_0, t_j) - P(x_i, y_0, z_0, t_j) = a\{v_x(x_i, y_0, z_0, t_{j+1}) - v_x(x_i, y_0, z_0, t_j)\} \quad \text{Equation 7}$$

$$\{v_x(x_{i+1}, y_0, z_0, t_j) - v_x(x_i, y_0, z_0, t_j)\} = b\cos\theta_x\{p(x_{i+1}, y_0, z_0, t_j) - p(x_{i+1}, y_0, z_0, t_{j-1})\}$$

$$P(x_0, y_{S+1}, z_0, t_j) - P(x_0, y_S, z_0, t_j) = a\{v_y(x_0, y_S, z_0, t_{j+1}) - v_y(x_0, y_S, z_0, t_j)\}$$

$$\{v_y(x_0, y_{S+1}, z_0, t_j) - v_y(x_0, y_S, z_0, t_j)\} = b\cos\theta_y\{p(x_0, y_{S+1}, z_0, t_j) - p(x_0, y_{S+1}, z_0, t_{j-1})\}$$

$$P(x_0, y_0, z_{R+1}, t_j) - P(x_0, y_0, z_R, t_j) = a\{v_Z(x_0, y_0, z_R, t_{j+1}) - v_z(x_0, y_0, z_R, t_j)\}$$

$$\{v_Z(x_0, y_0, z_{R+1}, t_j) - v_Z(x_0, y_0, z_R, t_j)\} = b\cos\theta_Z\{p(x_0, y_0, z_{R+1}, t_j) - p(x_0, y_0, z_{R+1}, t_{j-1})\}$$

where x, y and z are respective spatial axes.

By the above embodiment, a sound signal to be received in an arbitrary position in a space can be estimated with Equation 7 by estimating terms of b cos $\theta_x$, b cos $\theta_y$ and b cos $\theta_z$, regarding the average powers of the sound wave received by the four microphones as equal under the condition in which the sound wave coming from the sound source in arbitrary directions $\theta_x$, $\theta_y$ and $\theta_z$ to the four microphones can be regarded as a plane wave. Estimation is possible with a small number of microphones of 4, and thus it is possible to reduce the system scale.

In the first, second and third microphone array systems, sound signal estimation processing is performed with respect to a plurality of positions, and the following processing also can be performed: processing for enhancing a desired sound by synchronous addition of these estimated signals; processing for suppressing noise by synchronous subtraction of these estimated signals; and processing for detecting the position of a sound source by cross-correlation coefficient calculation processing and coefficient comparison processing.

The microphone array system of the present invention can estimate sound signals to be received in an arbitrary position on the same axis, regarding the average powers of the sound wave received by the two microphones as equal under the condition in which the sound wave coming from the sound source in an arbitrary direction θ to two microphones can be regarded as a plane wave. The present invention can estimate with a small number of, i.e., two microphones, which reduces the system scale. Moreover, by applying the same signal processing technique, the present invention can estimate sound signals to be received in an arbitrary position on the same plane, based on the sound signals received by three microphones, and can estimate sound signals to be received in an arbitrary position in a space, based on the sound signals received by four microphones.

Moreover, utilizing the results of the processing for estimating sound signals in a plurality of positions with a small number of microphones by the above signal processing technique, the microphone array system of the present invention can perform processing for enhancing a desired sound by synchronous addition of these signals, processing for suppressing noise by synchronous subtraction, processing for detecting the position of a sound source by processing for calculating a cross-correlation coefficient and coefficient comparison processing.

These and other advantages of the present invention will become apparent to those skilled in the art upon reading and understanding the following detailed description with reference to the accompanying figures.

DESCRIPTION OF THE PREFERRED EMBODIMENTS

A microphone array system of the present invention will be described with reference to the accompanying drawings.

First, the basic principle of sound signal estimation processing of the microphone array system of the present invention will be described. The principle of processing for estimating a sound signal to be received in an arbitrary position on the straight line (one dimension) on which two microphones are arranged will be described below.

Figure 1:
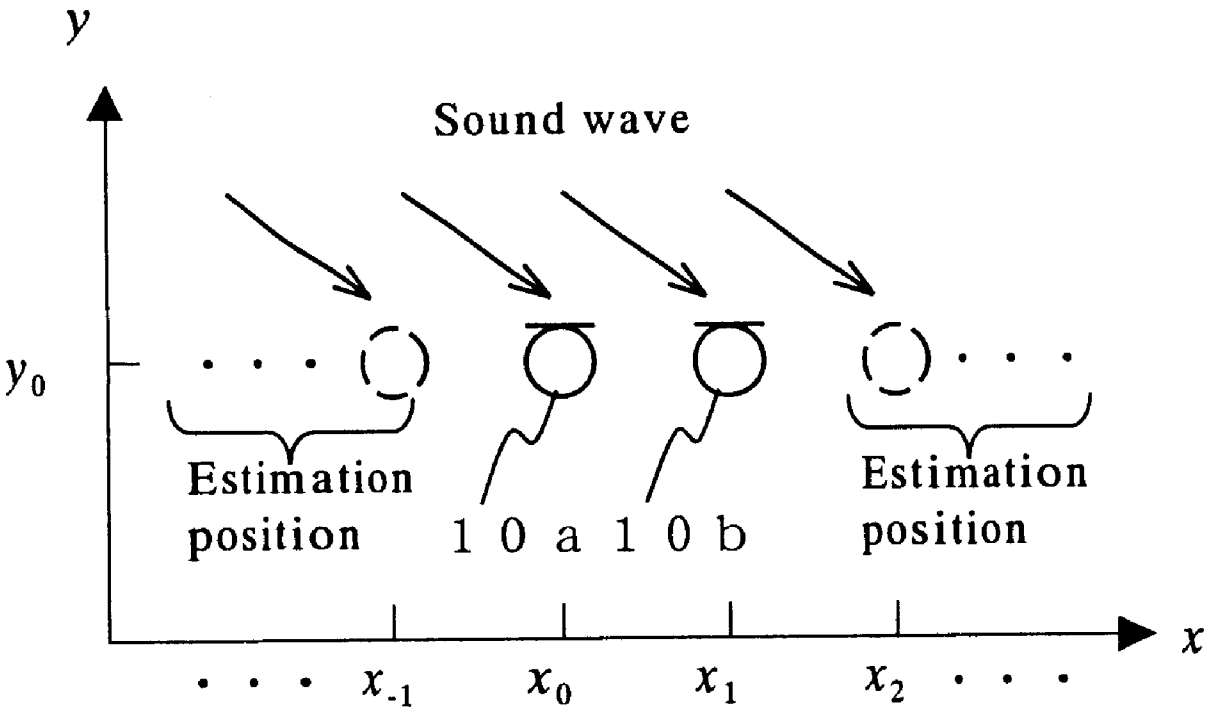
FIG. 1 is a diagram showing the outline of the basic configuration of a microphone array system of the present invention.

As shown in FIG. 1, using a microphone array constituted by two microphones 10*a* and 10*b*, sound signals to be received at a point $(x_i, y_0)$ (i=2, 3, . . . , i=−1, −2, . . . ) on the extension line of the arrangement of the microphones are estimated.

In propagation of a sound wave in the air, sound is an oscillatory wave of air particles, which are a medium for sound. Therefore, a changed value of the pressure in the air caused by the sound wave, that is, "sound pressure p", and the differential over time of the changed values (displacement) in the position of the air particles, that is, "air particle velocity v" are generated. In the present invention, sound signals to be received are estimated with a wave equation showing the relationship between the sound pressure and the particle velocity, based on the received sound signals measured by the two microphones. Now, assuming that a sound source is present in an arbitrary direction θ with respect to the microphones 10*a* and 10*b*, the sound pressure and the particle velocity at a point $(x_i, y_0)$ on the extension line of the arrangement of the microphones 10*a* and 10*b* are estimated, using a wave equation, based on the sound pressures p in the positions in which the microphones 10*a* and 10*b* are arranged and the particle velocity v as the boundary conditions. The sound pressures p in the positions in which the microphones 10*a* and 10*b* are arranged are measured by the microphones 10*a* and 10*b*, and the particle velocity is calculated based on the difference between the sound pressures measured by the microphones 10*a* and 10*b*.

In the case where the distance between the sound source and the microphones 10*a* and 10*b* is sufficiently long, the sound wave received by the microphones 10*a* and 10*b* can be regarded as a plane wave. For example, when the distance between the microphones 10*a* and 10*b* and the sound source is not less than about 10 times the distance between the microphones 10*a* and 10*b*, the sound wave can be regarded as a plane wave. The relationship between the sound pressure p (x, y, t) and the particle velocity v (x, y, t) is expressed by two equations, Equations 8 and 9 under the assumption that the received sound wave is a plane wave:

$$-\nabla p(x, y, t) = \rho \frac{\partial v(x, y, t)}{\partial t} \quad \text{Equation 8}$$

$$-\nabla v(x, y, t) = \frac{1}{K} \frac{\partial p(x, y, t)}{\partial t} \quad \text{Equation 9}$$

where t represents time, x and y represent rectangular coordinate axes that define the two-dimensional space, K represents the volume elasticity (ratio of pressure and dilatation), and ρ represents the density (mass per unit volume) of the air medium. The sound pressure p is a scalar, and the particle velocity v is a vector. ∇ (nabla) in Equations 8 and 9 represents a partial differential operation.

Equations 10 and 11 derived from Equations 8 and 9 show the relationship of the sound pressure and the particle velocity between the positions of the microphones shown in FIG. 1 and the arbitrary position (x, y) on the xy plane.

$$-\frac{\partial p(x, y, t)}{\partial x} = \rho \frac{\partial v_x(x, y, t)}{\partial t} \quad \text{Equation 10}$$

$$-\left(\frac{\partial v_x(x, y, t)}{\partial x} + \frac{\partial v_y(x, y, t)}{\partial y}\right) = \frac{1}{K} \frac{\partial p(x, y, t)}{\partial t} \quad \text{Equation 11}$$

where $v_x(x, y, t)$ represents the x axis component of the particle velocity v(x, y, t), and $v_y(x, y, t)$ represents the y axis component of the particle velocity v(x, y, t).

Equations 12 and 13 derived from Equations 10 and 11 show the relationship of the discrete values p ($x_i$, $y_0$, $t_j$), $v_x$ ($x_i$, $y_0$, $t_j$), and $v_y$ ($x_i$, $y_0$, $t_j$) of the sound pressure and the particle velocity in the position for estimation shown in FIG. 1.

$$p(x_{i+1}, y_0, t_j) - p(x_i, y_0, t_j) = a\{v_x(x_i, y_0, t_{j+1}) - v_x(x_i, y_0, t_j)\} \quad \text{Equation 12}$$

$$\{v_x(x_{i+1}, y_0, t_j) - v_x(x_i, y_0, t_j)\} + \{v_y(x_i, y_1, t_j) - v_x(x_i, y_0, t_j)\} = b\{p(x_{i+1}, y_0, t_j) - p(x_{i+1}, y_0, t_{j-1})\} \quad \text{Equation 13}$$

where $x_i$ and $y_0$ (i= . . . −2, −1, 0, 1, 2, . . . ) represent the positions of the microphones and the positions for estimation, $t_j$ represents the sampling time (i=0, 1, 2, . . . ), a and b represent constant coefficients. Each distance between the position of a microphone or the position for estimation and the position of the adjacent microphone or the position for estimation adjacent thereto is a value shown in Equation 14.

$$x_{i+1} - x_i = \frac{c}{F_s} \quad \text{Equation 14}$$

where c is the sound velocity, and $F_s$ is the sampling frequency.

As described above, sound signals can be estimated by calculating Equations 12 and 13. However, since the microphones 10*a* and 10*b* are arranged in parallel to the x axis, as shown in FIG. 1, the y axis component $v_y$ ($x_i$, $y_0$, $t_j$) and $v_y$ ($x_i$, $y_1$, $t_j$) in Equation 13 cannot be obtained directly. Therefore, the y axis component of the particle velocity is removed from Equation 13, and the relationship between the difference of the x component ($x_i$, $y_0$, $t_j$) of the particle velocity on the x axis and the difference of the sound pressure $p_x$ ($x_i$, $y_0$, $t_j$) on the time axis is shown in Equation 15 with the sound source direction θ.

$$\{v_x(x_{i+1}, y_0, t_j) - v_x(x_i, y_0, t_j)\} = b \cos\theta\{p(x_{i+1}, y_0, t_j) - p(x_{i+1}, y_0, t_{j-1})\} \quad \text{Equation 15}$$

In the case where Equation 15 is used as it is, the number of sound sources and the positions thereof are necessary. However, it is preferable that a sound signal to be received can be estimated even if the direction of the sound source with respect to the x axis is not known, and the sound source is in an arbitrary direction. Therefore, in the present invention, since it is assumed that the sound wave coming from the sound source is a plane wave, the average of the power, namely the sum of squares, of the particle velocity $v_x$ ($x_i$, $y_0$, $t_j$) is substantially equal to that of the particle velocity $v_x$ ($x_{i+1}$, $y_0$, $t_j$). Using this, b cos θ in Equation 15 is estimated.

The sum of squares of Equation 15 is shown by Equation 16.

$$\sum_{j=0}^{L-1} v_x^2(x_{i+1}, y_0, t_j) = \sum_{j=0}^{L-1} [v_x(x_i, y_0, t_j) + b\cos\theta\{p(x_{i+1}, y_0, t_j) - p(x_{i+1}, y_0, t_{j-1})\}]^2 \quad \text{Equation 16}$$

where L represents a frame length for calculating the sum of squares.

When the frame length L is sufficiently long, the sums of squares of the particle velocities $v_x$ ($x_i$, $y_0$, $t_j$) and $v_x$ ($x_{i+1}$, $y_0$, $t_j$) are equal, as shown in Equation 17.

$$\sum_{j=0}^{L-1} v_x^2(x_{i+1}, y_0, t_j) = \sum_{j=0}^{L-1} v_x^2(x_i, y_0, t_j) \quad \text{Equation 17}$$

From Equations 16 and 17, b cos θ becomes a function of $x_i$ and $t_j$, and it can be calculated as shown in Equation 18.

$$b\cos\theta = \frac{-2\sum_{j=0}^{L-1} v_x(x_i, y_0, t_j)\{p(x_{i+1}, y_0, t_{j+1}) - p(x_{i+1}, y_0, t_j)\}}{\sum_{j=0}^{L-1} \{p(x_{i+1}, y_0, t_j) - p(x_{i+1}, y_0, t_{j-1})\}^2} \quad \text{Equation 18}$$

Using Equation 18, b cos θ is calculated with signals input from the microphone array, and using Equations 12 and 15, the sound pressures and the particle velocities in the position for estimation of the sound waves coming from a plurality of sound sources in arbitrary directions can be estimated.

Figure 2:
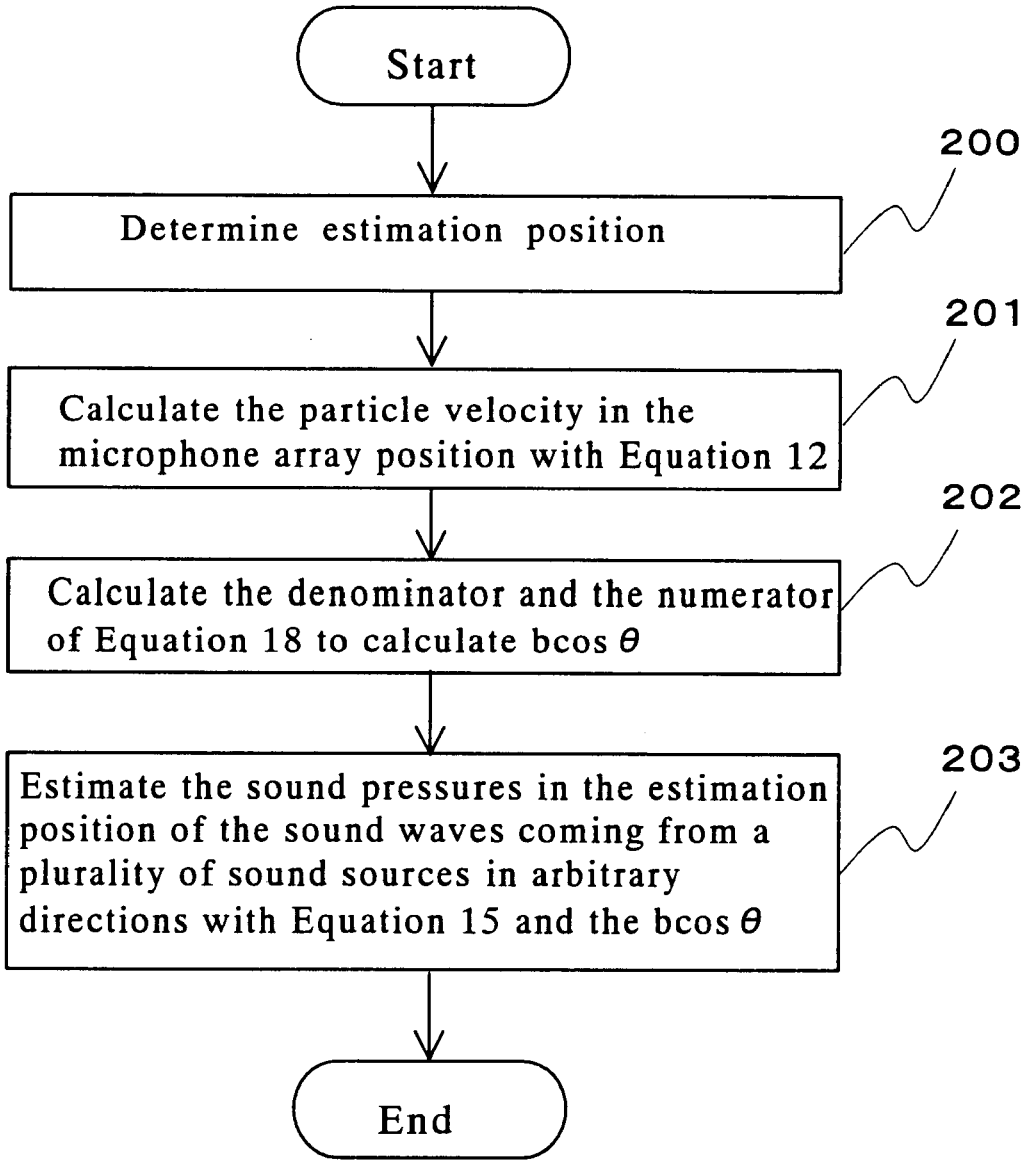
FIG. 2 is a flowchart showing the outline of the signal processing procedure of a microphone array system of Embodiment 1 of the present invention.

FIG. 2 is a flowchart showing the above described procedure for estimation processing, where the subscript j of t is the sampling number, k is the frame number for calculating the sum of squares, and 1 is the sampling number in the frame.

The microphone array system of the present invention estimates the sound pressure and the particle velocity in the position for estimation under the basic principle described above. The above-described basic principle has been described by taking estimation processing in an arbitrary position on the same axis based on the sound signals received by two microphones as an example. However, if three microphones that are not on the same straight line are used, processing for estimating a sound signal to be received in an arbitrary position in another axis direction is performed and two estimation results are synthesized, so that a sound signal to be received in an arbitrary position on a plane can be estimated. Similarly, if four microphones that are not on the same plane are used, processing for estimating a sound signal to be received in an arbitrary position in each of the three axis directions is performed and three estimation results are synthesized, so that a sound signal to be received in an arbitrary position in a space can be estimated.

Hereinafter, embodiments of the microphone array system of the present invention will be described with reference to specific system configurations.

Embodiment 1

In a microphone array system of Embodiment 1, two microphones are arranged, and the system estimates a sound signal to be received in an arbitrary position on the same straight line where the two microphones are arranged. Wave equation are derived, regarding the sound wave coming from the sound source to the two microphones as a plane wave, and assuming that the average power of the sound wave reaching one of the two microphones is equal to that of the other microphone.

Figure 3:
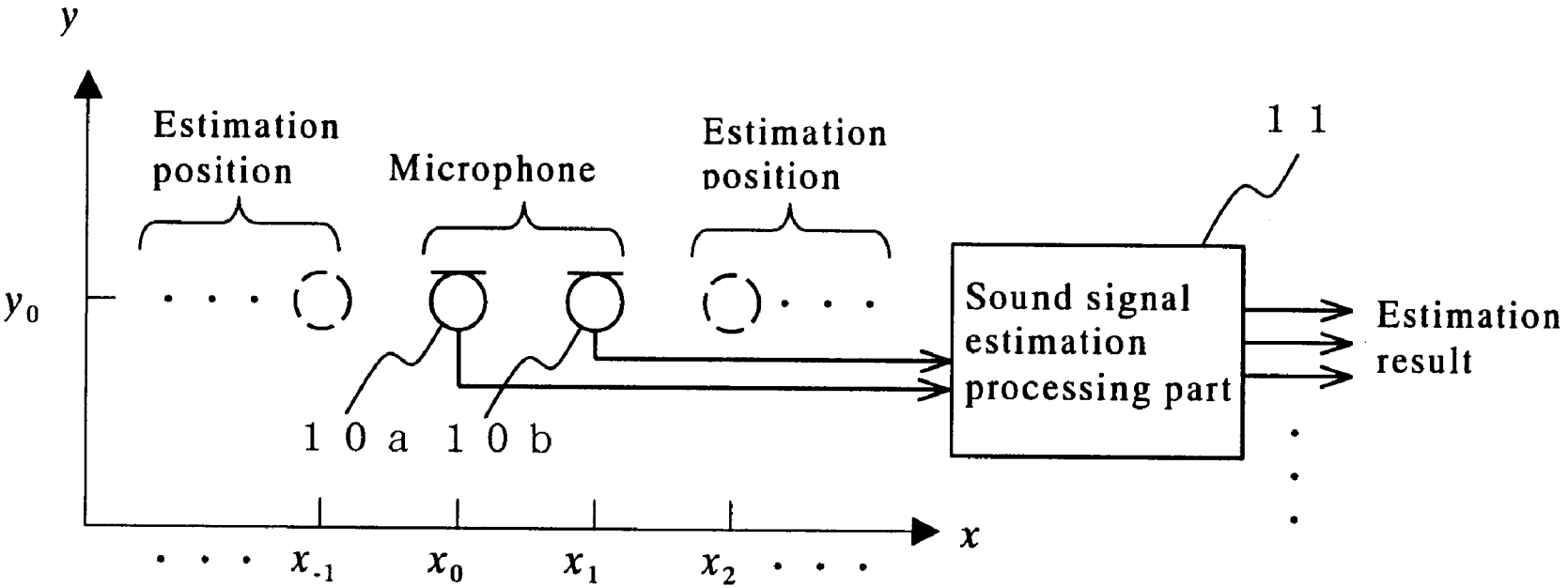
FIG. 3 is a diagram showing the outline of the basic configuration of a microphone array system of Embodiment 1 of the present invention.

FIG. 3 is a diagram showing the outline of the system configuration of the microphone array system of Embodiment 1 of the present invention.

In FIG. 3, reference numerals 10*a* and 10*b* denote microphones, and reference numeral 11 denotes a sound signal estimation processing part.

The microphones 10*a* and 10*b* are arranged in parallel to the x axis (($x_0$, $y_0$) and ($x_1$, $y_0$)), and the position for estimation is an arbitrary position ($x_i$, $y_0$) on the extension line of the line segment connecting the microphones 10*a* and 10*b*. In Embodiment 1, the microphones are non-directional microphones.

The sound signal estimation processing part 11 is, for example, a DSP (digital signal processor), to which sound signals received by the microphones 10*a* and 10*b* and the parameters from the outside are input, and it performs the predetermined signal processing shown in the flowchart of FIG. 2.

For simplification, in the system configuration of FIG. 3, a controller, a memory, necessary peripheries or the like are not shown, where appropriate.

In the microphone array system of Embodiment 1, it is assumed that the distance between the sound source in an arbitrary direction θ with respect to the system and the microphone array is not less than about 10 times the distance between microphones 10*a* and 10*b*, and that the sound wave coming from the sound source can be regarded as a plane wave. The sound wave is received by the microphones 10*a* and 10*b*, and the received sound signals are input to the sound signal estimation processing part 11. As described in the basic principle, the sound signal estimation processing part 11 is programmed to execute the process procedure shown in the flowchart of FIG. 2. First, a position for estimation is determined (operation 200). The position for estimation can be expressed by ($x_i$, $y_0$). Next, the particle velocity in the position of the microphone array is calculated with Equation 12 (operation 201). Then, the denominator and the numerator of Equation 18 are calculated and b cos θ is calculated (operation 202). Next, the sound pressures in the position for estimation of the sound waves coming from a plurality of sound sources in arbitrary directions are estimated with Equation 15 and the b cos θ (operation 203).

By the above-processes, a sound signal in an arbitrary position on the same line can be estimated based on the sound signals received by the two microphones.

Next, the results of the simulation experiment for the estimation of a sound signal to be received in an arbitrary position on the same line based on the sound signals received by the two microphones of the present invention are shown below.

Figure 4:
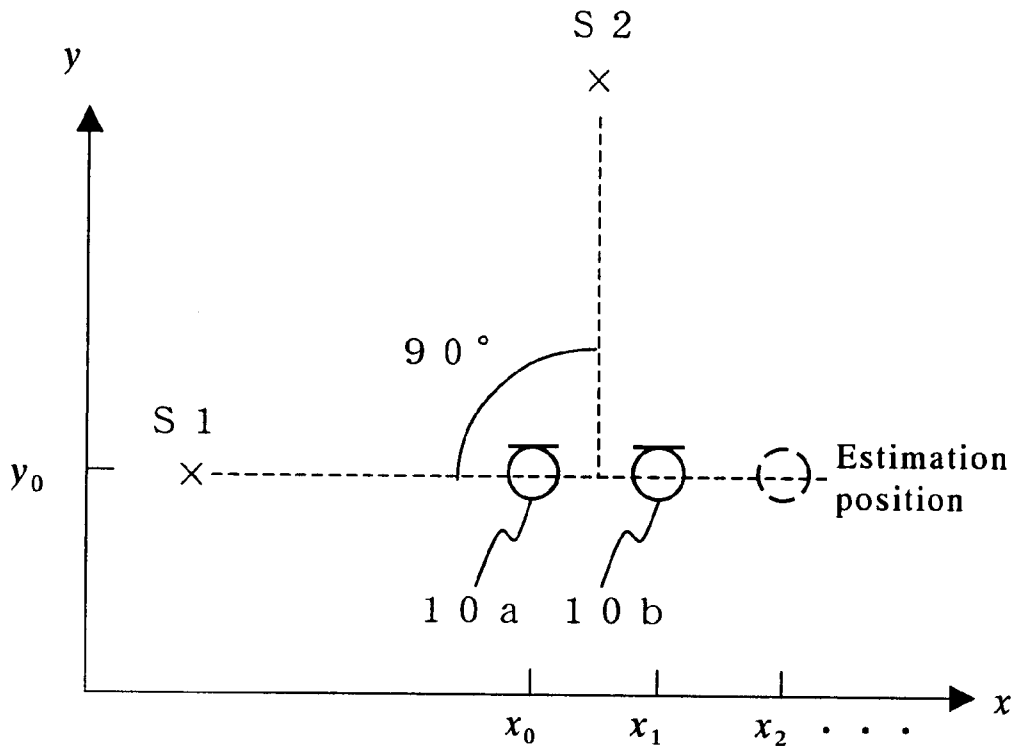
FIG. 4 is a diagram showing the system configuration used for simulation tests of estimation processing by a microphone array system of Embodiment 1 of the present invention.
Figure 5:
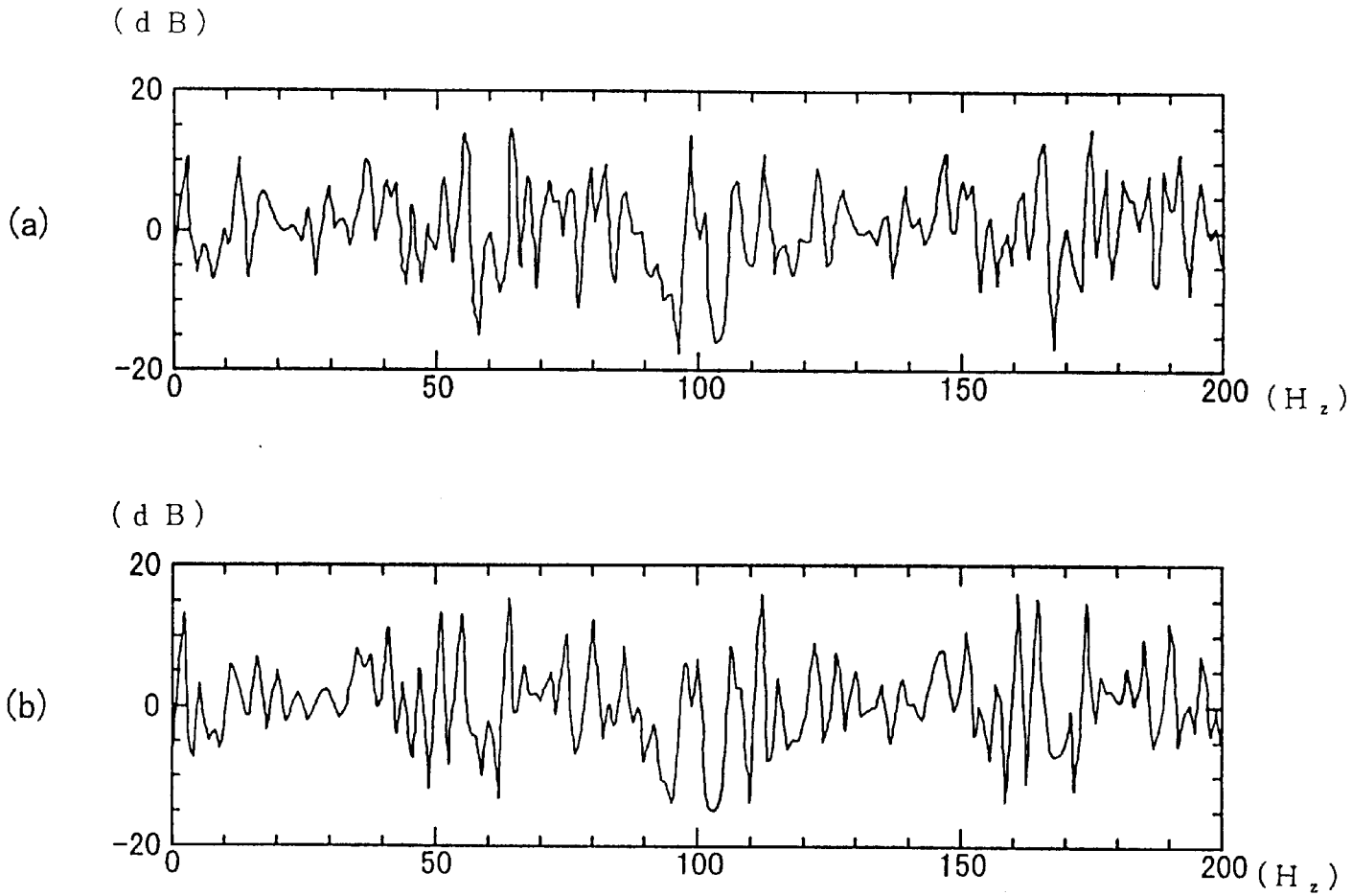
FIG. 5 is a diagram showing the results of the simulation tests of estimation processing by a microphone array system of Embodiment 1 of the present invention.

As shown in FIG. 4, the microphone array system of the present invention is constituted by two microphones 10*a* and 10*b*, and simulation experiment for estimation of a sound signal to be received in a position ($x_2$, $y_0$) is performed. The sampling frequencies of the microphones 10*a* and 10*b* are both 11.025 kHz, and the distance therebetween is about 3 cm. S1 and S2 are white noise sources and at least 30 cm apart from the microphones 10*a* and 10*b*. The sound waves from S1 and S2 can be regarded as plane waves in the positions of the microphones 10*a* and 10*b*. FIGS. 5A and 5B are the simulation results. FIG. 5A shows a received sound signal obtained by measuring the sound waves coming from the white noise sources S1 and S2 received by the microphone actually provided at ($x_2$, $y_0$). FIG. 5B shows the result of the sound signal estimation processing by the microphone array system of the present invention. The comparison between FIGS. 5A and 5B shows that the result of the sound signal estimation processing of FIG. 5B substantially reflects the characteristic of the actual sound wave signal coming from the sound sources shown in FIG. 5A As described above, if the microphone array system of this embodiment of the present invention is used, by arranging only two microphones and measuring the sound signals received by the two microphones, a sound signal to be received in an arbitrary position on the same straight line where the two microphone are arranged can be estimated.

Embodiment 2

In a microphone array system of Embodiment 2, three microphones are arranged in such a manner that they are not on one straight line, and the system estimates a sound signal to be received in an arbitrary position on the same plane on which the three microphones are arranged. As in Embodiment 1, wave equations are derived, regarding the sound wave coming from the sound source to the three microphones as a plane wave, and assuming that the average power of the sound wave reaching each of the three microphones is equal to those of the other microphones.

The microphone array system of Embodiment 1 performs estimation processing for a position on a straight line (one dimension), whereas the microphone array system of Embodiment 2 performs estimation processing for a position on a plane (two dimensions). Thus, this embodiment uses an one more dimension.

Figure 6:
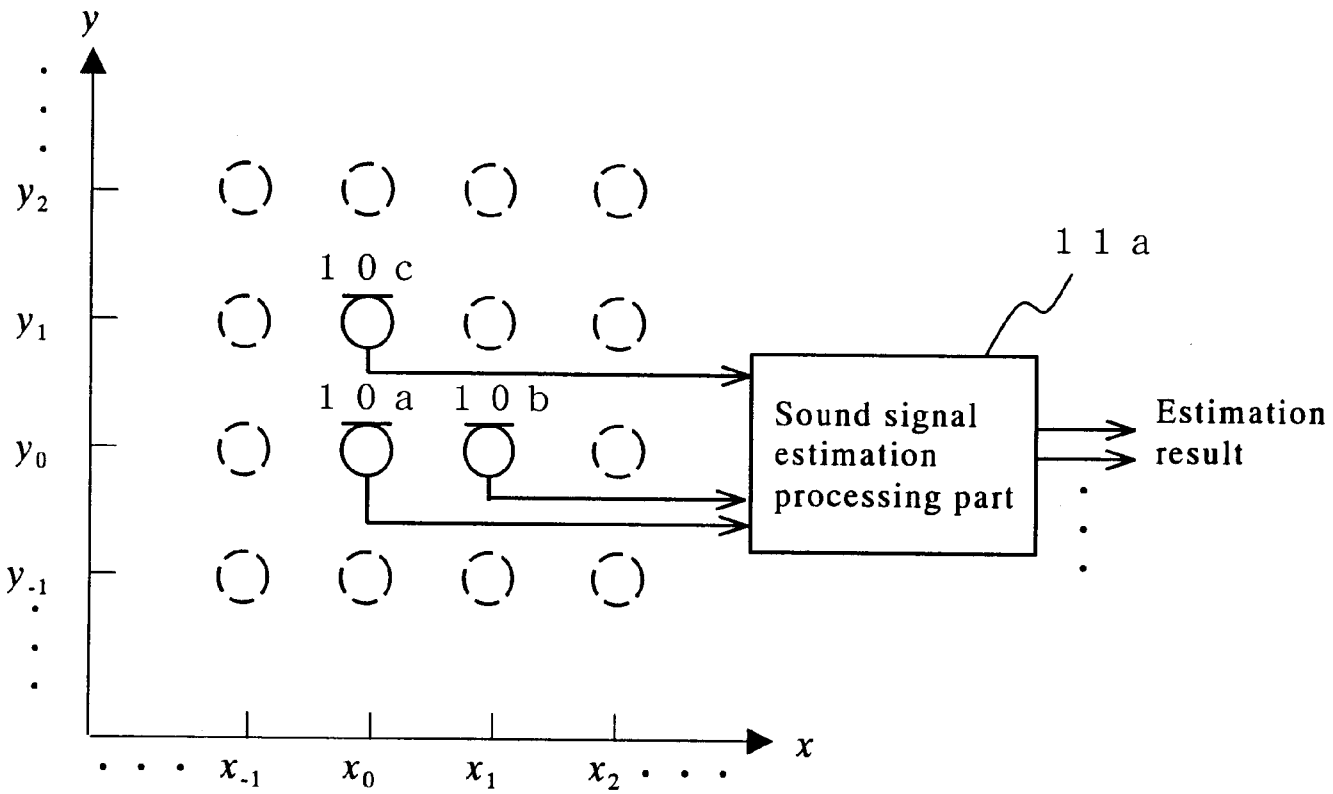
FIG. 6 is a diagram showing the outline of the basic configuration of a microphone array system of Embodiment 2 of the present invention.

FIG. 6 is a diagram showing the outline of the system configuration of the microphone array system of Embodiment 2 of the present invention.

In FIG. 6, reference numerals 10*a*, 10*b* and 10*c* denote microphones, and reference numeral 11*a* denotes a sound signal estimation processing part. Also in Embodiment 2, the microphones are non-directional microphones and the sound signal estimation processing part 11*a* is a DSP.

As shown in FIG. 6, the microphones 10*a* and 10*b* are arranged in parallel to the x axis in the same manner as in Embodiment 1, and the microphones 10*a* and 10*c* are arranged in parallel to the y axis.

For simplification, also in Embodiment 2, in the system configuration of FIG. 6, a controller, a memory, necessary peripheries or the like are not shown, where appropriate.

In Embodiment 2 as well as in Embodiment 1, it is assumed that the distance between the sound source and the microphone array is not less than about 10 times the distance between the microphones 10*a* and 10*b* or between 10*a* and 10*c*, and that the sound wave coming from the sound source can be regarded as a plane wave. The sound wave is received by the microphones 10*a*, 10*b* and 10*c*, and the received sound signals are input to the sound signal estimation processing part 11*a*.

As in Embodiment 1, the sound signal estimation processing part 11*a* is programmed to execute the process procedure shown in the flowchart of FIG. 2. However, in Embodiment 2, programming is performed with respect to the two directions of the x axis and the y axis.

First, a position for estimation is determined, and the point on the x coordinate and the point on the y coordinate of that position are obtained. When the xy coordinate is expressed by ($x_i$, $y_s$: where i and s are integers), the point ($x_i$, $y_0$) on the x coordinate and the point ($x_0$, $y_s$) on the y coordinate are determined. The procedures of operations 200 to 203 are performed with respect to each direction of the x axis and the y axis, so that sound signals to be received at the point ($x_i$, $y_0$) on the x coordinate and the point ($x_0$, $y_s$) on the y coordinate are estimated. The sound signal to be received at the point ($x_0$, $y_s$) on the y coordinate can be estimated by substantially the same estimation processing as that in Embodiment 1, although the variable is different between x and y, and therefore the description thereof is omitted in Embodiment 2, where appropriate.

After the sound signals to be received at the point ($x_i$, $y_0$) on the x coordinate and the point ($x_0$, $y_s$) on the y coordinate are estimated, the results of the former and the latter are added and synthesized so that an estimated sound signal to be received in the position for estimation ($x_i$, $y_s$) is obtained.

As described above, according to the microphone array system of Embodiment 2, by arranging three microphones in such a manner that they are not on one straight line, a sound signal to be received in an arbitrary position on the same plane where the three microphone are arranged can be estimated.

Embodiment 3

In a microphone array system of Embodiment 3, four microphones are arranged in such a manner that they are not on the same plane, and the system estimates a sound signal to be received in an arbitrary position in a space. As in Embodiment 1, wave equations are derived, regarding the sound wave coming from the sound source to the four microphones as a plane wave, and assuming that the average power of the sound wave reaching each of the four microphones is equal to those of the other microphone.

The microphone array system of Embodiment 2 performs estimation processing for a position on a plane (two dimensions), whereas the microphone array system of Embodiment 3 performs estimation processing for a position in a space (three dimensions). Thus, this embodiment uses one more dimension.

Figure 7:
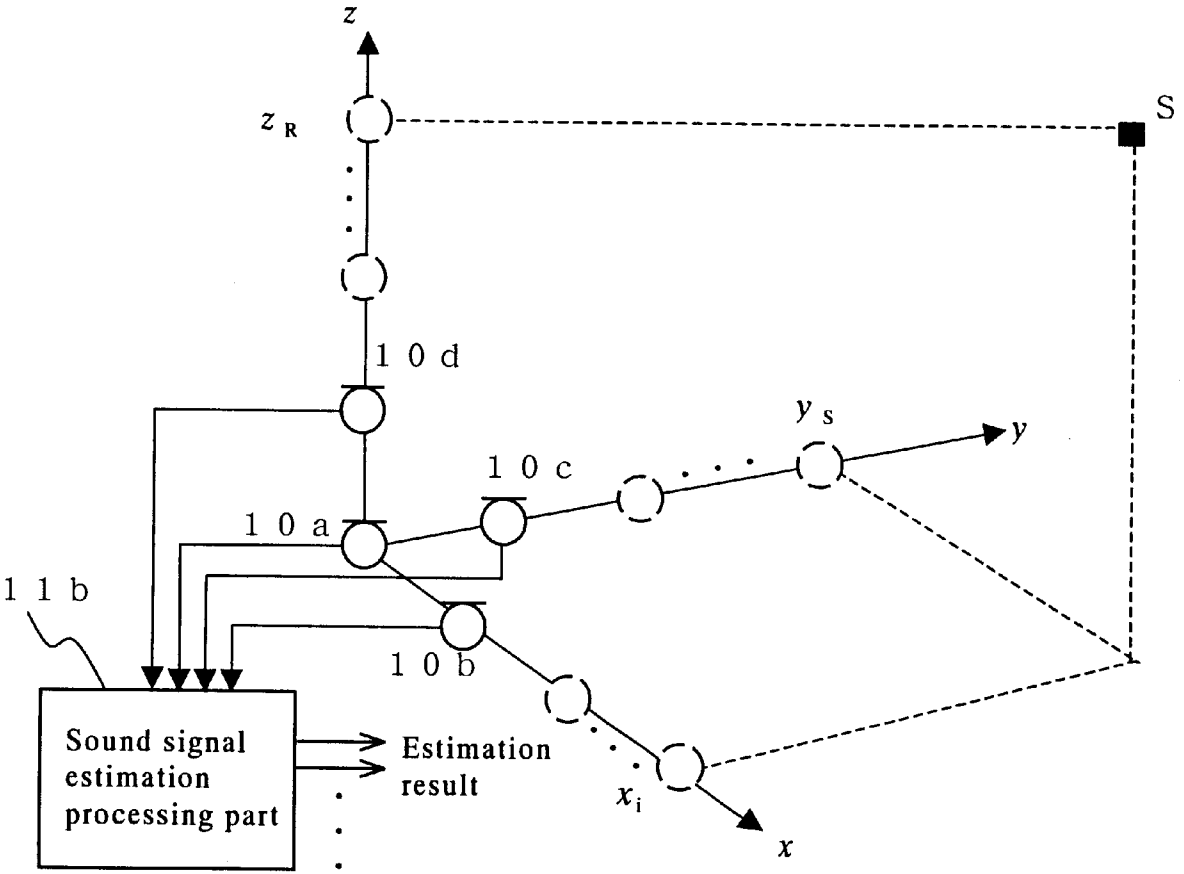
FIG. 7 is a diagram showing the outline of the basic configuration of a microphone array system of Embodiment 3 of the present invention.

FIG. 7 is a diagram showing the outline of the system configuration of the microphone array system of Embodiment 3 of the present invention.

In FIG. 7, reference numerals 10*a* to 10*d* denote microphones, and reference numeral 11*b* denotes a sound signal estimation processing part. Also in Embodiment 3, the microphones are non-directional microphones and the sound signal estimation processing part 11*b* is a DSP.

As shown in FIG. 7, the microphones 10*a* and 10*b* are arranged in parallel to the x axis in the same manner as in Embodiment 1, and the microphones 10*a* and 10*c* are arranged in parallel to the y axis in the same manner as in Embodiment 2. The microphones 10*a* and 10*d* are arranged in parallel to the z axis.

For simplification, also in Embodiment 3, in the system configuration of FIG. 7, a controller, a memory, necessary peripheries or the like are not shown, where appropriate.

In Embodiment 3 as well as in Embodiment 1, it is assumed that the distance between the sound source and the microphone array is not less than about 10 times the distance between microphones 10*a* and 10*b* to 10*d*, and that the sound wave coming from the sound source can be regarded as a plane wave. The sound wave is received by the microphones 10*a* to 10*d*, and the received sound signals are input to the sound signal estimation processing part 11*b*.

As in Embodiment 1, the sound signal estimation processing part 11*b* is programmed to execute the process procedure shown in the flowchart of FIG. 2. However, in Embodiment 3, programming is performed with respect to the three directions of the x axis, the y axis and the z axis.

First, a position for estimation is determined, and the point on the x coordinate, the point on the y coordinate and the point on the z coordinate of that position are obtained. When the xyz coordinate is expressed by ($x_i$, $y_s$, $z_R$: where i, s and R are integers), the point ($x_i$, $y_0$, $z_0$) on the x coordinate, the point ($x_0$, $y_0$, $z_R$) on the y coordinate and the point ($x_0$, $y_0$, $z_R$) on the z coordinate are determined.

The procedures of operations 200 to 203 are performed with respect to each direction of the x axis, the y axis and the z axis, so that sound signals to be received at the point ($x_i$, $y_0$, $z_0$) on the x coordinate, the point ($x_0$, $y_s$, $z_0$) on the y coordinate and the point ($x_0$, $y_0$, $z_R$) on the z coordinate are estimated. The sound signal to be received at the point ($x_0$, $y_s$, $z_0$) on the y coordinate and the point ($x_0$, $y_0$, $z_R$) on the z coordinate can be estimated by substantially the same estimation processing as that in Embodiment 1, although the variables are different, and therefore the description thereof is omitted in this embodiment, where appropriate.

After the sound signals to be received at the point ($x_i$, $y_0$, $z_0$) on the x coordinate, the point ($x_0$, $y_s$, $z_0$) on the y coordinate and the point ($x_0$, $y_0$, $z_R$) on the z coordinate are estimated, the results thereof are added and synthesized so that an estimated sound signal to be received in the position for estimation ($x_i$, $y_s$, $z_R$) is obtained.

As described above, according to the microphone array system of Embodiment 3, by arranging four microphones in such a manner that they are not on the same plane, a sound signal to be received in an arbitrary position in a space can be estimated.

Embodiment 4

A microphone array system of Embodiment 4 also has a function of processing for enhancing a desired sound, in addition to the processing for estimating a sound signal to be received in an arbitrary position provided by the microphone array systems of Embodiments 1 to 3. In this embodiment, for convenience, an example of the system configuration of Embodiment 1 having an additional function of processing for enhancing a desired sound is shown. However, it is also possible to add the function of processing for enhancing a desired sound to the system configuration of Embodiment 2 or 3, which will not be described further.

Figure 8:
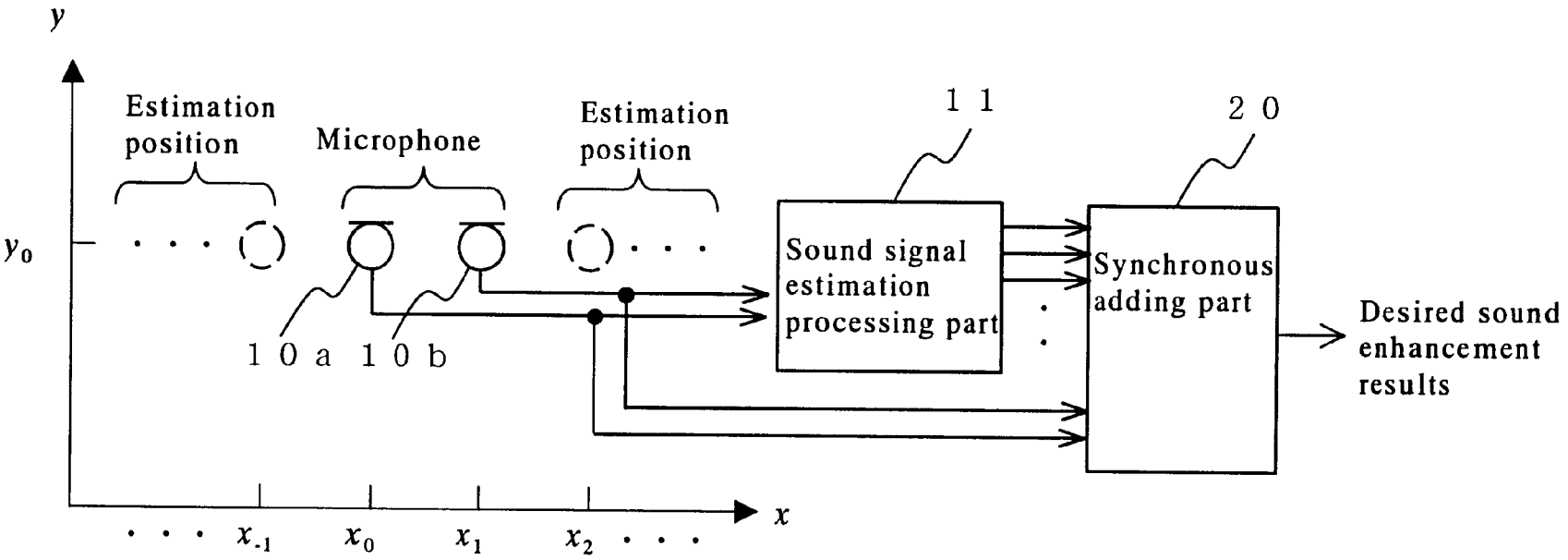
FIG. 8 is a diagram showing the outline of the basic configuration of a microphone array system of Embodiment 4 of the present invention.

FIG. 8 is a diagram showing the outline of the system configuration of the microphone array system of Embodiment 4 of the present invention.

Figure 9:
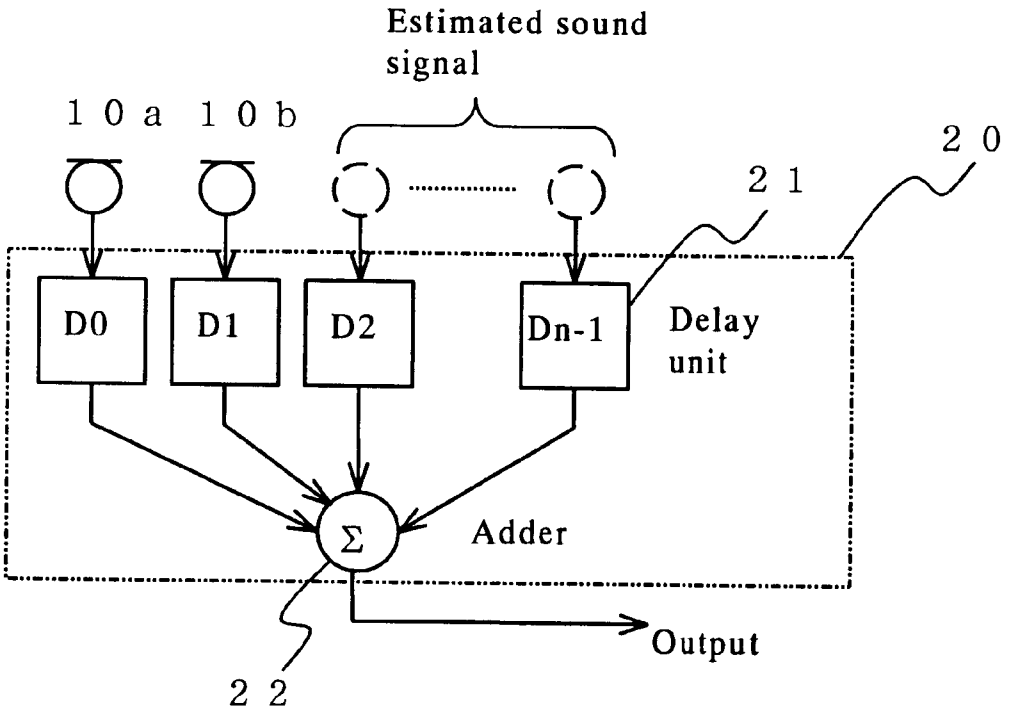
FIG. 9 is a diagram showing an example of the configuration of a synchronous adding part 20.

In FIG. 8, reference numerals 10*a* and 10*b* denote microphones, and reference numeral 11 denotes a sound signal estimation processing part. These elements are the same as those shown in Embodiment 1, and therefore the description thereof is omitted in this embodiment, where appropriate. Reference numeral 20 is a synchronous adding part. Sound signals received by the microphones 10*a* and 10*b* and estimated sound signals in the positions for estimation estimated by the sound signal estimation processing part 11 are input to the synchronous adding part 20. The synchronous adding part 20 includes delay units 21(0) to 21(n−1), each of which corresponds to one of the received sound signals and the estimated sound signals that are input thereto, as shown in FIG. 9, and also includes an adder 22 for adding the delay-processed sound signals.

The processing for estimating a sound signal to be received in an arbitrary position $(x_i, y_0)$ is performed in the same manner as in Embodiment 1 described with reference to the flowchart of FIG. 2, and therefore the description thereof is omitted in this embodiment.

The processing for enhancing a desired sound executed by the synchronous adder 20 is as follows. In the case where the sound source of the desired sound is in direction $\theta_d$, an output $r(t_j)$ is obtained by synchronous addition of the sound pressures in the positions $(x_i, y_0)$ (i=−(n−2), . . . , 0, . . . , n −1) with Equation 19.

$$r(t_j) = \sum_{i=-(n-2)}^{n-1} p(x_i, y_0, t_{j+k}) \qquad \text{Equation 19}$$

where k is varied, depending on the direction $\theta_d$ of the sound source of the desired sound, as shown in Equation 20.

$$k = i \cos \theta_d \qquad \text{Equation 20}$$

where noise other than the desired sound cannot be added synchronously using Equation 19, when the direction $\theta_n$ is $\theta_d \neq \theta_n$. Therefore, noise is not enhanced and only the desired sound is enhanced so that a directional microphone having a high gain in the direction of the sound source of the desired sound can be obtained.

As described above, according to the microphone array system of Embodiment 4, a directional microphone having a high gain in the direction of the sound source of the desired sound can be obtained by performing the synchronous addition of the received sound signals and the estimated sound signals. The system configurations of the microphone array systems of Embodiments 1 to 3 can be used as the system configuration part that performs the processing for estimating sound signals.

Embodiment 6

A microphone array system of Embodiment 5 also has a function of processing for suppressing noise, in addition to the processing for estimating a sound signal to be received in an arbitrary position provided by the microphone array systems of Embodiments 1 to 3. In this embodiment, for convenience, an example of the system configuration of Embodiment 1 having an additional function of processing for suppressing noise is shown. However, it is also possible to add the function of processing for suppressing noise to the system configuration of Embodiment 2 or 3, which will not be described further in this embodiment.

Figure 10:
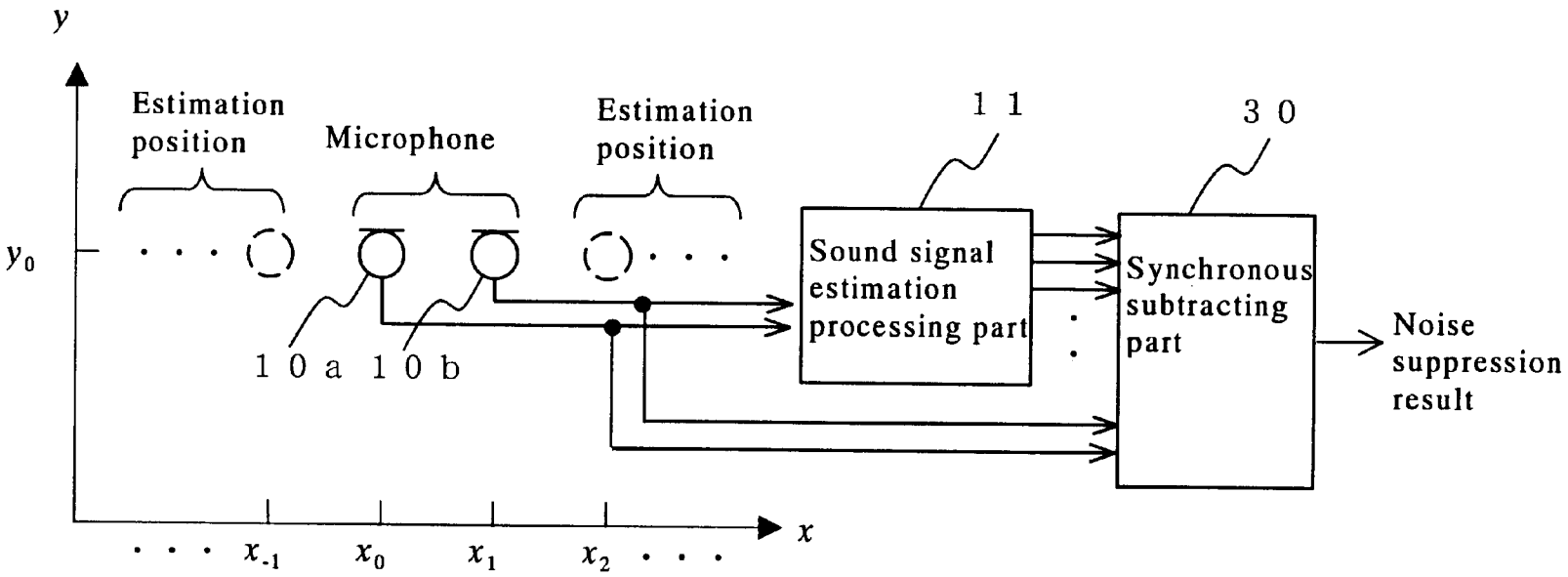
FIG. 10 is a diagram showing the outline of the basic configuration of a microphone array system of Embodiment 5 of the present invention.

FIG. 10 is a diagram showing the outline of the system configuration of the microphone array system of Embodiment 5 of the present invention.

In FIG. 10, reference numerals 10*a* and 10*b* denote microphones, and reference numeral 11 denotes a sound signal estimation processing part. These elements are the same as those shown in Embodiment 1, and therefore the description thereof is omitted in this embodiment, where appropriate. Reference numeral 30 is a synchronous subtracting part. The synchronous subtracting part 30 includes delay units 31(0) to 31(n−1) corresponding to the received sound signals by the microphones 10*a* and 10*b* and the estimated sound signals, and also includes a subtracter 32 for subtracting the delay-processed sound signals. The adder 22 in FIG. 9 is replaced by the subtracter 32 in this embodiment, which is not shown in the drawings.

The processing for estimating a sound signal to be received in an arbitrary position $(x_i, y_0)$ is performed in the same manner as in Embodiment 1 described with reference to the flowchart of FIG. 2, and therefore the description thereof is omitted in this embodiment.

The processing for suppressing noise executed by the synchronous subtracting part 30 is as follows. In this embodiment, noise is suppressed by synchronous subtraction of the sound pressures in the positions $(x_i, y_0)$ (i=−(n−2), . . . , 0, . . . , n−1), when there are 2n−3 sound sources of noise, as shown in Equation 21. The direction of the sound source of noise is shown as $\theta_1, \ldots, \theta_{-2n-3}$.

Step 1 — Equation 21

$$P_1(x_i, y_0, t_j) = P(x_i, y_0, t_j) - P(x_{i+1}, y_0, t_{j+\cos\theta 1})\}$$

$$i = -(n-2), \ldots, 0, \ldots, n-2$$

Step 2

$$P_2(x_i, y_0, t_j) = P_1(x_i, y_0, t_j) - P_1(x_{i+1}, y_0, t_{j+\cos\theta 2})\}$$

$$i = -(n-2), \ldots, 0, \ldots, n-3$$

$$\vdots$$

Step 2n-4

$$P_{2n-4}(x_i, y_0, t_j) = P_{2n-5}(x_i, y_0, t_j) - P_{2n-5}(x_{i+1}, y_0, t_{j+\cos\theta 2n-4})\}$$

-continued $$i = -(n-2), n-3$$

Step 2n-3

$$r(t_j) = P_{2n-4}(x_i, y_0, t_j) - P_{2n-4}(x_{i+1}, y_0, t_{j+\cos\theta 2n-3})\}$$

$$i = -(n-2)$$

This $r(t_j)$ is the result of the synchronous subtraction.

As described above, according to the microphone array system of Embodiment 5, the processing for suppressing noise can be performed by the synchronous subtraction of the received sound signals and the estimated sound signals. The system configurations of the microphone array systems of Embodiments 1 to 3 can be used as the system configuration part that performs the processing for estimating sound signals.

Embodiment 6

A microphone array system of Embodiment 6 also has a function of processing for detecting the position of a sound source by calculating cross-correlation coefficients based on the sound signals received by the microphones, in addition to the function provided by the microphone array systems of Embodiments 1 to 3. In this embodiment, for convenience, an example of the system configuration of Embodiment 1 having an additional function of processing for detecting the position of a sound source is shown. However, it is also possible to add the function of processing for detecting the position of a sound source to the system configuration of Embodiment 2 or 3, which will not be described further in this embodiment.

Figure 11:
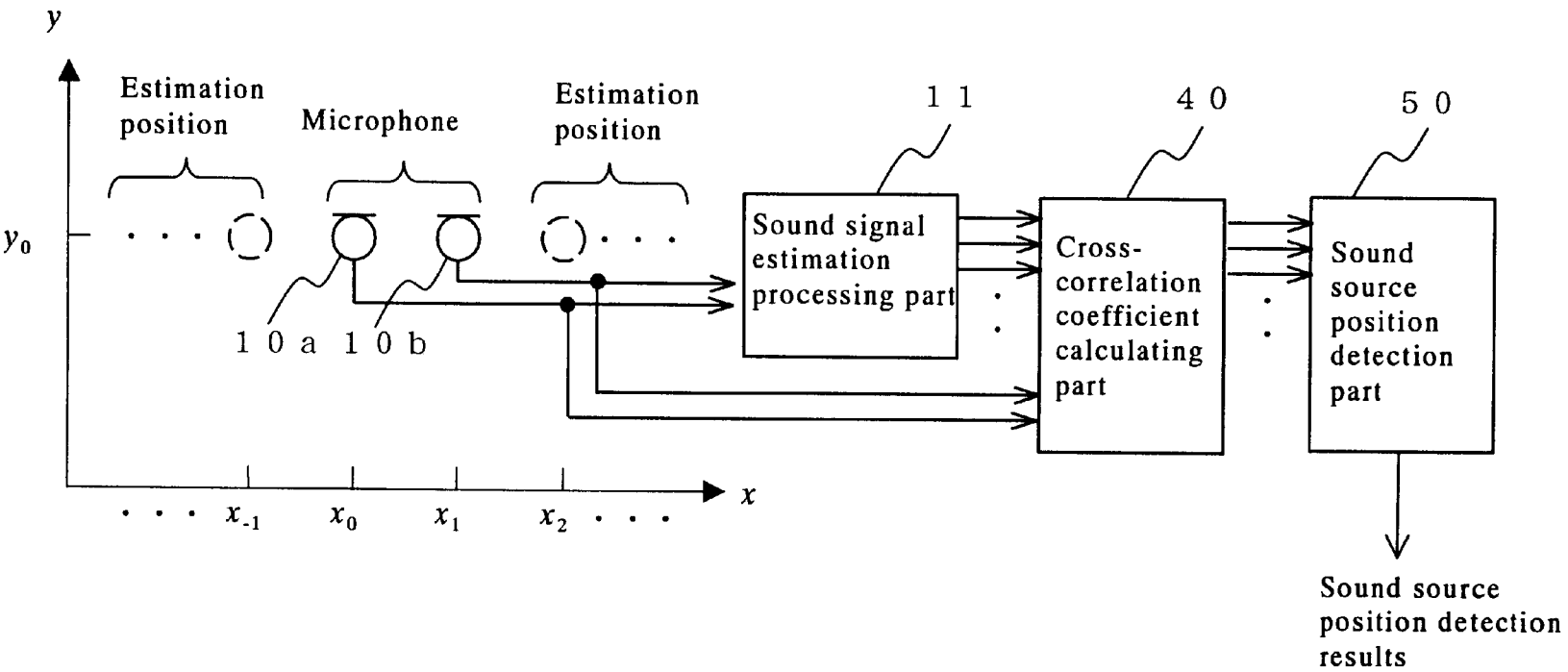
FIG. 11 is a diagram showing the outline of the basic configuration of a microphone array system of Embodiment 6 of the present invention.

FIG. 11 is a diagram showing the outline of the system configuration of the microphone array system of Embodiment 6 of the present invention.

In FIG. 11, reference numerals 10*a* and 10*b* denote microphones, and reference numeral 11 denotes a sound signal estimation processing part. These elements are the same as those shown in Embodiment 1, and therefore the description thereof is omitted in this embodiment, where appropriate. Reference numeral 40 is a part for calculating a cross-correlation coefficient, and reference numeral 50 is a part for detecting the position of a sound source. The part for calculating a cross-correlation coefficient 40 receives the sound signals received by the microphones 10*a* and 10*b* and the sound signals estimated by the sound signal estimation processing part 11, and calculates the cross-correlation coefficients between the signals. The part for detecting the position of a sound source 50 detects the direction in which the correlation between the signals is the largest, based on the cross-correlation coefficients between the signals calculated by the part for calculating a cross-correlation coefficient 40.

The processing for estimating a sound signal to be received in an arbitrary position $(x_i, y_0)$ is performed in the same manner as in Embodiment 1 described with reference to the flowchart of FIG. 2, and therefore the description thereof is omitted in this embodiment. The cross-correlation coefficient between the signals is calculated by the part for calculating a cross-correlation coefficient 40 with Equation 22 below.

$$r(\theta) = \sum_j \prod_{i=-(n-2)}^{n-1} P(x_i, y_0, t_{j+ik}) \qquad \text{Equation 22}$$

where $$k = i \cos(\theta)$$

The part for detecting the position of a sound source 50 detects the direction in which the cross-correlation coefficient $r(\theta)$ is the largest.

As described above, according to the microphone array system of Embodiment 6, the position of a sound source can be detected by calculating the cross-correlation coefficients between the signals based on the received sound signals and the estimated sound signals. The system configurations of the microphone array systems of Embodiments 1 to 3 can be used as the system configuration part that performs the processing for estimating sound signals.

Embodiment 7

A microphone array system of Embodiment 7 detects the position of a sound source by calculating cross-correlation coefficients based on the sound signals received by the microphones and enhances the desired sound in that direction, in addition to performing the function provided by the microphone array systems of Embodiments 1 to 3. In this embodiment, for convenience, an example of the system configuration of Embodiment 1 having an additional function of processing for detecting the position of a sound source is shown. However, it is also possible to add the function of processing for detecting the position of a sound source to the system configuration of Embodiment 2 or 3, which will not be described further in this embodiment.

Figure 12:
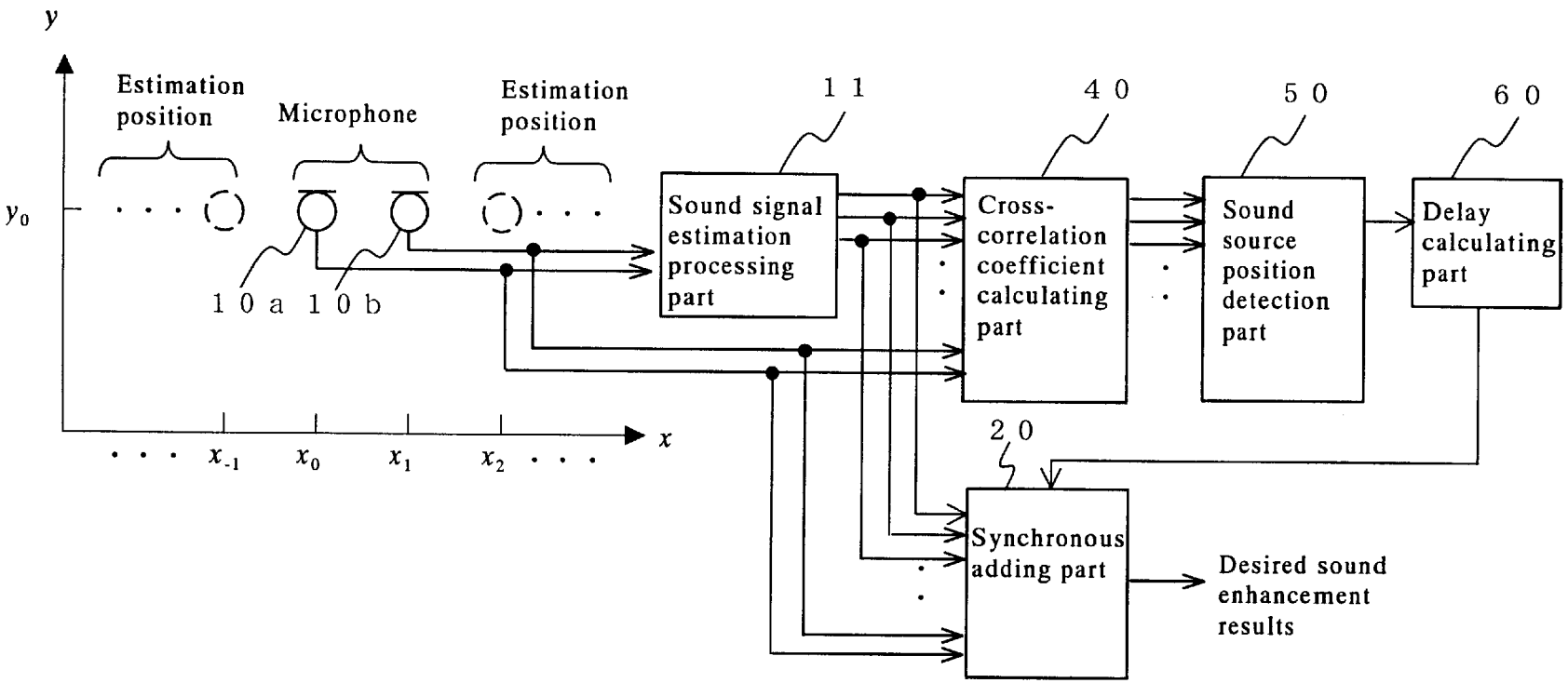
FIG. 12 is a diagram showing the outline of the basic configuration of a microphone array system of Embodiment 7 of the present invention.

FIG. 12 is a diagram showing the outline of the system configuration of the microphone array system of Embodiment 7 of the present invention.

The system configuration of this embodiment is a combination of Embodiment 4 of FIG. 8 and Embodiment 6 of FIG. 11. In FIG. 12, reference numerals 10*a* and 10*b* denote microphones, reference numeral 11 denotes a sound signal estimation processing part, reference numeral 20 is a synchronous adding part, reference numeral 40 is a part for calculating a cross-correlation coefficient, reference numeral 50 is a part for detecting the position of a sound source, and reference numeral 60 is a delay calculating part. The functions of the microphones 10*a* and 10*b*, the sound signal estimation processing part 11, the synchronous adding part 20, the part for calculating a cross-correlation coefficient 40, the part for detecting the position of a sound source 50 are the same as those described in Embodiments 1, 4 and 6, and therefore the description thereof is omitted in this embodiment, where appropriate.

The microphone array system of Embodiment 7 performs the processing for estimating sound signals to be received in an arbitrary position $(x_i, y_0)$ by the sound signal estimation processing part 11, based on the signals received by the microphones 10*a* and 10*b* in the same manner as in Embodiment 6. The part for calculating a cross-correlation coefficient 40 calculates the cross-correlation coefficients between all the signals of the sound signals received by the microphones 10*a* and 10*b* and the sound signals estimated by the sound signal estimation processing part 11. The part for detecting the position of a sound source 50 detects the direction in which the correlation between the signals is the largest.

Next, it is determined that the desired sound is in that direction, and the desired sound is enhanced. First, delay amounts in the positions of the microphones 10*a* and 10*b* and the positions for estimation are calculated by the delay calculating part 60 while the microphones are directed to the direction of the desired sound. The synchronous adding part 20 performs the synchronous addition processing described in Embodiment 4 using the signals from the delay calculating part 60 as the parameters to enhance the desired sound.

As described above, according to the microphone array system of Embodiment 7, the position of a sound source can be detected by calculating the cross-correlation coefficients between the signals based on the received sound signals and the estimated sound signals, and the desired sound in that direction can be enhanced. The system configurations of the microphone array systems of Embodiments 1 to 3 can be used as the system configuration part that performs the processing for estimating sound signals.

Embodiment 8

A microphone array system of Embodiment 8 has two functions of stereo sound input and desired sound enhancement, using two unidirectional microphones. The two directional microphones are arranged with an angle so that they can perform stereo sound input.

Figure 13:
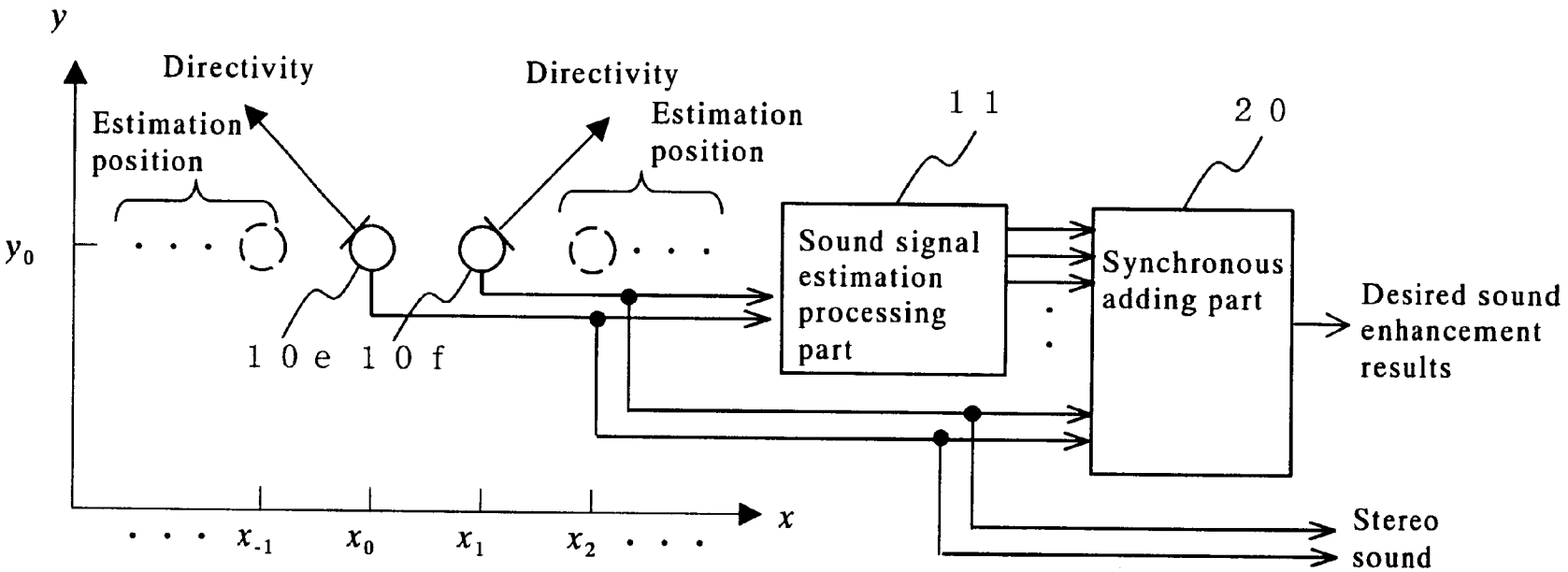
FIG. 13 is a diagram showing the outline of the basic configuration of a microphone array system of Embodiment 8 of the present invention.

FIG. 13 is a diagram showing the outline of the system configuration of the microphone array system of Embodiment 8 of the present invention.

In FIG. 13, unidirectional microphones 10*e* and 10*f* are arranged so that the directivity of each of the microphones is directed to the direction suitable for stereo sound input. A sound signal estimation processing part 11 acts in the same manner as that described in Embodiment 1. It executes the processing for estimating a sound signal to be received in an arbitrary position for estimation $(x_i, y_0)$, based on the signals received by the unidirectional microphones 10*e* and 10*f*A synchronous adding part 20 adds the sound signals received by the unidirectional microphones 10*e* and 10*f* and the sound signals to be received in positions for estimation so that the desired sound is enhanced.

Here, it is possible to select and output either of the stereo signal by the unidirectional microphones 10*e* and 10*f* or the result of the desired sound enhancement from the synchronous adding part 20. Alternatively, it is possible to output the former and the latter at the same time.

As described above, according to the microphone array system of Embodiment 8, the position of a sound source can be detected by calculating the cross-correlation coefficients between the signals based on the received sound signals and the estimated sound signals. The system configurations of the microphone array systems of Embodiments 1 to 3 can be used as the system configuration part that performs the processing for estimating sound signals.

As described above, the microphone array system of Embodiment 8 can have two functions of stereo sound input and desired sound enhancement by using two unidirectional microphones.

Embodiment 9

A microphone array system of Embodiment 9 has two functions of stereo sound input and desired sound enhancement, using two unidirectional microphones, as in Embodiment 8. In addition, the microphone array system of Embodiment 9 has the function of detecting the distance to the sound source and selects either one of the stereo sound input output or the desired sound enhancement, depending on that distance. The output can be switched in such a manner that one of the outputs is selected, but in this embodiment, the output is switched smoothly by adjusting the gains of the former and the latter.

Figure 14:
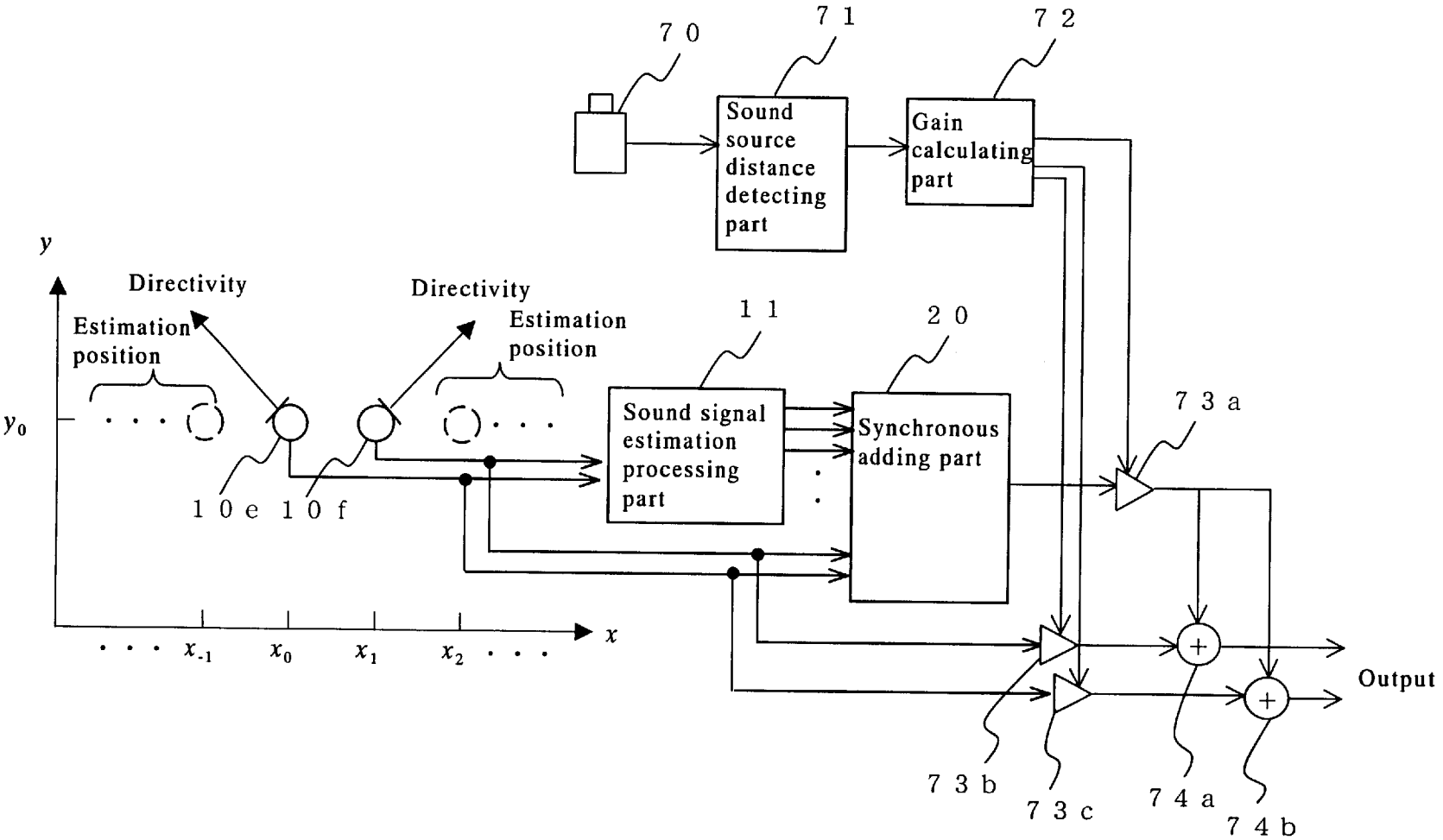
FIG. 14 is a diagram showing the outline of the basic configuration of a microphone array system of Embodiment 9 of the present invention.

In FIG. 14, unidirectional microphones 10*e* and 10*f* are arranged so that the strong directivity is directed to the direction suitable for stereo sound input. A sound signal estimation processing part 11 executes the processing for estimating a sound signal to be received in an arbitrary position for estimation $(x_i, y_0)$, based on the signals received by the unidirectional microphones 10*e* and 10*f*. A synchronous adding part 20 adds the sound signals received by the unidirectional microphones 10*e* and 10*f* and the sound signals to be received in positions for estimation so that the desired sound is enhanced. These operations are the same as those in Embodiment 8.

In the example shown in FIG. 14, the distance to the sound source is detected by performing image information processing based on an image captured by a camera. Reference numeral 70 is a camera, reference numeral 71 is a part for detecting the distance to a sound source, reference numeral 72 is a gain calculating part, reference numerals 73*a* to 73*c* are gain adjusters, and reference numeral 74 is an adder. The part for detecting the distance to a sound source 71 performs image information processing based on an image captured by a camera 70. Various techniques for image information processing to detect the distance are known, and for example, a method of measuring a face area can be used.

Figure 15:
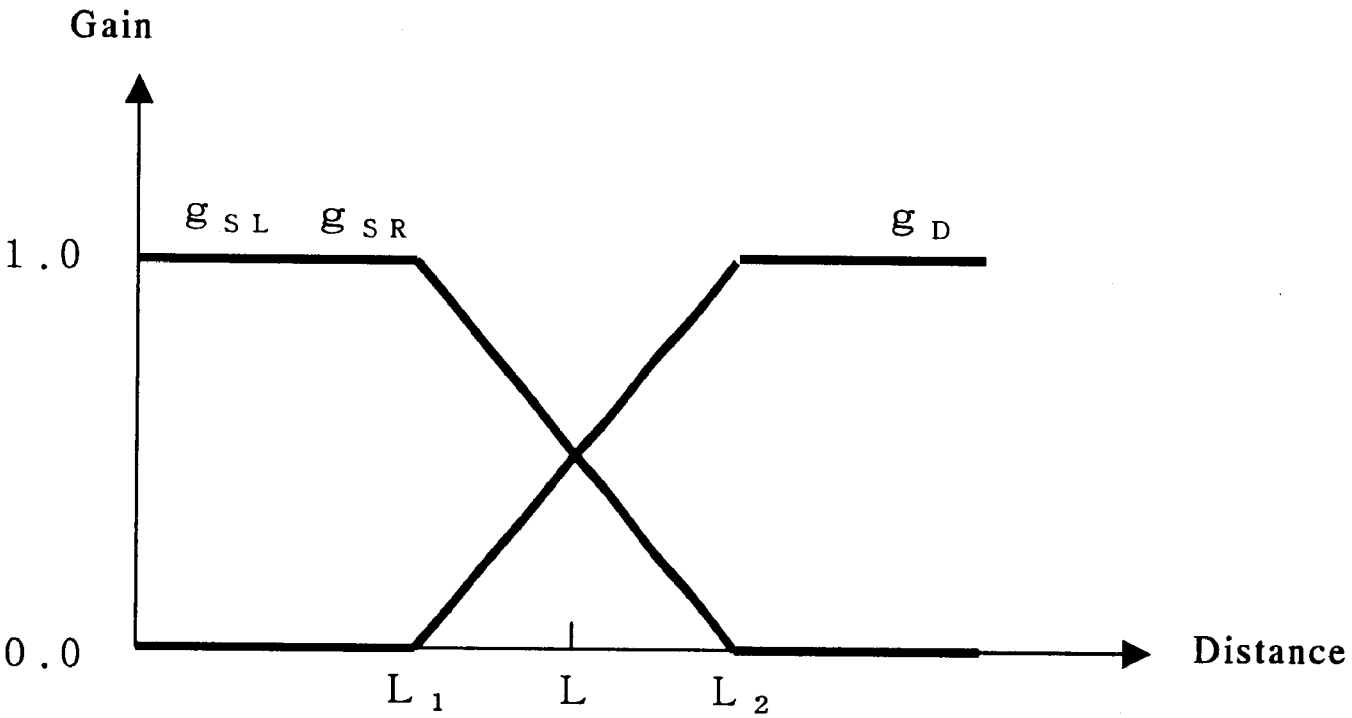
FIG. 15 is a diagram showing the relationship between the distance to the sound source and the set gain amount in the microphone array system of Embodiment 9 of the present invention.

The gain calculating part 72 calculates the gain amounts that are supplied to the desired sound enhancement output from the synchronous adding part 20 and the stereo sound input output from the microphones. In switching the stereo sound input and the desired sound enhancement output, roughly speaking, it is better to select the stereo sound input when the distance between the sound source and the microphones is sufficiently short. On the other hand, it is better to select the desired sound enhancement when the distance is sufficiently long. Here, distance L as the threshold for switching the former and the latter can be introduced. As shown in FIG. 15, when the gain amounts of the two outputs are adjusted so that they are reversed smoothly with this L as the center, the two outputs can be switched smoothly. The gain calculating part 72 calculates the gain amounts of the two outputs according to FIG. 15, based on the results of the detection of the part for detecting the distance to a sound source 71, and adjusts the gain amount of the gain adjusters 73*a* to 73*c*. In FIG. 15, $g_{SL}$ is the gain amount on the left side of the stereo signal, $g_{SR}$ is the gain amount on the right side of the stereo signal, and $g_D$ is the gain amount of the desired sound enhancement signal. The signals whose gain amounts are adjusted are added in the adders 74*a* and 74*b*, so that a synthesized sound is output. As seen in FIG. 15, when the distance between the sound source and the microphones is within L1, only the stereo sound input is output. When the distance between the sound source and the microphones is L2 or more, only the desired sound enhancement output is output. When the distance between the sound source and the microphones is between L1 to L2, a sound signal with weight synthesized from the former and the latter is output.

In the above example, the image captured by a camera is used for detecting the position of the sound source. However, the position of the sound source can be detected by other methods, for example, measuring the distance based on the arrival time of ultrasonic reflection wave, using an ultrasonic sensor.

As described above, the microphone array system of Embodiment 9 can have two functions of stereo sound input and desired sound enhancement by using two unidirectional microphones, and further has the function of detecting the distance to a sound source and can select either one of the stereo sound input output or the desired sound enhancement, depending on that distance.

Embodiment 10

A microphone array system of Embodiment 10 uses two microphones and performs processing for suppressing noise by detecting the number of noise sources and the directions thereof by the cross-correlation calculation, determining the number of points for estimation of sound signals in accordance with the number of noise sources, and performing synchronous subtraction based on the sound signals received by the microphones and the estimated sound signals.

Figure 16:
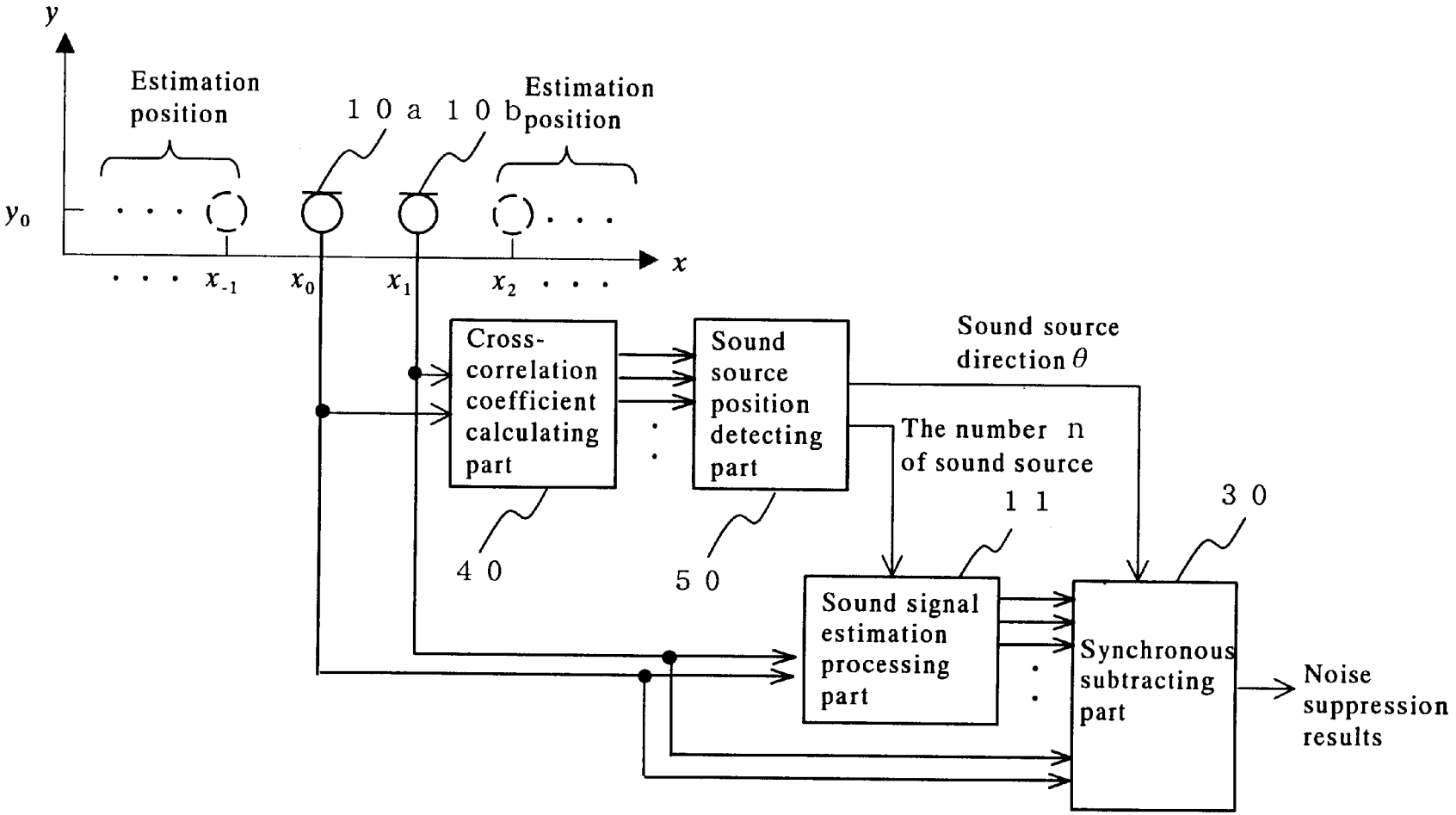
FIG. 16 is a diagram showing the outline of the basic configuration of a microphone array system of Embodiment 10 of the present invention.
Figure 17:
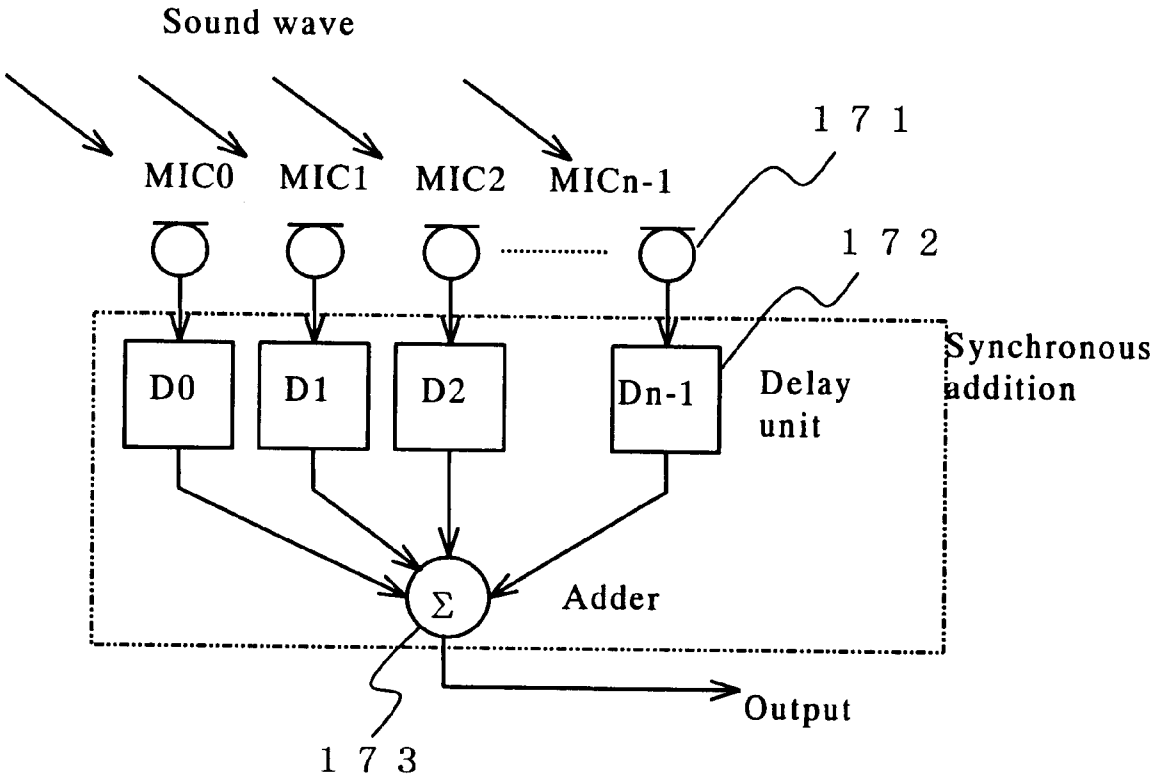
FIG. 17 is a diagram showing a microphone array system used for processing for enhancing a desired sound by a conventional synchronous addition.

FIG. 16 is a diagram showing the outline of the system configuration of the microphone array system of Embodiment 10 of the present invention.

In FIG. 16, reference numerals 10*a* and 10*b* are microphones, reference numeral 11 is a sound signal estimation processing part, and reference numeral 30 is a synchronous subtracting part. These elements are the same as those shown in Embodiment 5. The sound signal estimation processing part 11 has the function of determining the number of the position for estimation ($x_i$, $y_0$), using the number n of noise sources supplied from a part for detecting the position of a sound source 50 as the parameters, as described later. The synchronous subtracting part 30 has the function of suppressing noise in each direction, using the directions θ1, θ2, . . . , θn of the noise sources supplied from the part for detecting the position of a sound source 50 as the parameters, as described later. Reference numeral 40 is a part for calculating a cross-correlation coefficient, and reference numeral 50 is the part for detecting the position of a sound source. These elements are the same as those shown in Embodiment 6. However, this embodiment is different from Embodiment 6 in that the signals input to the part for calculating a cross-correlation coefficient 40 are the sound signals received by the microphones 10*a* and 10*b*, and not the signals from the sound signal estimation processing part 11.

The microphone array system of Embodiment 10 functions as follows. First, the sound signals received by the microphones 10*a* and 10*b* are input to the part for calculating a cross-correlation coefficient 40, which calculates the cross-correlation coefficient in each direction. The part for detecting the position of a sound source 50 detects the number of noise sources and the directions thereof by examining the peaks of the cross-correlation coefficients. The detected number of noise sources is expressed by n, and each direction thereof is expressed by θ1, θ2, . . . , θn.

The number n of noise sources detected by the part for detecting the position of a sound source 50 is supplied to the sound signal estimation processing part 11. The sound signal estimation processing part 11 sets {(n+1)− the number of real microphones} positions for estimation, using n as the parameter. More specifically, the total of the number of the real microphones and the number of positions for estimation is set to a number of one more than the number of noise sources. Next, the synchronous subtracting part 30 performs synchronous subtraction processing so as to suppress received sound signals from each direction of the directions θ1, θ2, . . . , θn of the noise sources detected by the part detecting the position of a sound source 50, based on the sound signals received by the microphones 10*a* and 10*b* and the estimated sound signals to be received in the positions for estimation.

As described above, the microphone array system of Embodiment 10 can perform processing for suppressing noise by detecting the number of noise sources and the directions thereof by cross-correlation coefficient calculation, determining the number of points for estimation of sound signals in accordance with the number of noise sources and performing synchronous subtraction based on the sound signals received by the microphones and the estimated sound signals, using two microphones.

The above-described embodiments use a specific number of microphones, specific arrangement and a specific distance between the microphones that constitutes the microphone array system. However, these are only examples for convenience for description and not limiting.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A microphone array system comprising two microphones and a sound signal estimation processing part, which estimates a sound signal to be received in an arbitrary position on a straight line on which the two microphones are arranged, wherein the sound signal estimation processing part expresses a estimated sound signal to be received in a position on the straight line on which the two microphones are arranged by a wave equation Equation 1, assuming that a sound wave coming from a sound source to the two microphones is a plane wave, the sound signal estimation processing part estimates a coefficient b cos θ of the wave equation Equation 1 that depends on a direction from which a sound wave comes, assuming that an average power of the sound wave that reaches each of the two microphones is equal to that of the other microphone, and the sound signal estimation processing part estimates a sound signal to be received in an arbitrary position on a same axis on which the microphones are arranged, based on sound signals received by the two microphones, $$P(x_{i+1}, y_0, t_j) - P(x_i, y_0, t_j) = a\{v_x(x_i, y_0, t_{j+1}) - v_x(x_i, y_0, t_j)\} \qquad \text{Equation 1}$$

$$\{v_x(x_{i+1}, y_0, t_j) - v_x(x_i, y_0, t_j)\} = b\cos\theta\{p(x_{i+1}, y_0, t_j) - p(x_{i+1}, y_0, t_{j-1})\}$$

where x and y are respective spatial axes, t is a time, v is a air particle velocity, p is a sound pressure, a and b are coefficients, and θ is a direction of a sound source.

2. The microphone array system according to claim 1, wherein a distance between the microphones is not more than a value shown in Equation 4, $$x_{i+1} - x_i = \frac{C}{F_s} \quad \text{Equation 4}$$

where c is a sound velocity, and $F_s$ is a sampling frequency.

3. The microphone array system according to claim 1, comprising a synchronous adding part, wherein the sound signal estimation processing part executes the sound signal estimation processing with respect to a plurality of positions, and the synchronous adding part adds obtained sound signal estimation results synchronously, whereby the microphone array system performs processing for enhancing a desired sound of the sound source.

4. The microphone array system according to claim 1, comprising a synchronous subtracting part, wherein the sound signal estimation processing part executes the sound signal estimation processing with respect to a plurality of positions, and the synchronous subtracting part subtracts obtained sound signal estimation results synchronously, whereby the microphone array system performs processing for suppressing noise by subtracting sound signals coming from the sound source.

5. The microphone array system according to claim 1, comprising a part for calculating a cross-correlation coefficient and a part for detecting a position of a sound source, wherein the sound signal estimation processing part executes the sound signal estimation processing with respect to a plurality of positions, the part for calculating a cross-correlation coefficient performs processing for calculating cross-correlation coefficients of obtained sound signal estimation results, and the part for detecting a position of a sound source performs processing for detecting the position of the sound source by comparing coefficients based on the cross-correlation coefficient calculation results.

6. The microphone array system according to claim 3, wherein the microphones are directional microphones, and the microphone array system comprises stereo sound input processing with the directional microphones and the processing for enhancing a desired sound.

7. The microphone array system according to claim 6, comprising a movable camera and a part for detecting a distance to a sound source, wherein the part for detecting a distance to a sound source switches the processing for enhancing a desired sound in an imaging direction of the movable camera and the stereo sound input processing, based on the distance to the sound source detected by the part for detecting a distance to a sound source, and executes the selected processing.

8. The microphone array system according to claim 4, comprising a part for calculating a cross-correlation coefficient and a part for detecting a position of a sound source, wherein the part for calculating a cross-correlation coefficient calculates cross-correlation coefficients based on sound signals received by the microphones, the part for detecting a position of a sound source detects the number of noise sources based on the cross-correlation coefficient calculation results, the sound signal estimation processing part determines the number of positions for estimation of sound signals based on the detected number of noise sources and executes the sound signal estimation processing, and the synchronous subtracting part subtracts obtained sound signal estimation results synchronously, whereby the microphone array system performs processing for suppressing noise by subtracting sound signals coming from the noise sources.

9. A microphone array system comprising three microphones that are not on a same straight line and a sound signal estimation processing part, which estimates a sound signal to be received in an arbitrary position on a same plane on which the three microphones are arranged, wherein the sound signal estimation processing part expresses a estimated sound signal to be received in a position on the same plane on which the three microphones are arranged by a wave equation Equation 2, assuming that a sound wave coming from a sound source to the three microphones is a plane wave, the sound signal estimation processing part estimates coefficients b cos $\theta_x$ and b cos $\theta_y$ of the wave equation Equation 2 that depend on a direction from which a sound wave comes, assuming that an average power of the sound wave that reaches each of the three microphones is equal to those of the other microphones, and the sound signal estimation processing part estimates a sound signal to be received in an arbitrary position on the same plane on which the microphones are arranged, based on sound signals received by the three microphones, $$\begin{aligned} &P(x_{i+1}, y_0, t_j) - P(x_i, y_0, t_j) = \\ &\qquad a\{v_x(x_i, y_0, t_{j+1}) - v_x(x_i, y_0, t_j)\} \\ &\{v_x(x_{i+1}, y_0, t_j) - v_x(x_i, y_0, t_j)\} = \\ &\qquad b\cos\theta_x\{p(x_{i+1}, y_0, t_j) - p(x_{i+1}, y_0, t_{j-1})\} \\ &P(x_0, y_{S+1}, t_j) - P(x_0, y_S, t_j) = \\ &\qquad a\{v_y(x_0, y_S, t_{j+1}) - v_y(x_0, y_S, t_j)\} \\ &\{v_y(x_0, y_{S+1}, t_j) - v_y(x_0, y_S, t_j)\} = \\ &\qquad b\cos\theta_y\{p(x_0, y_{S+1}, t_j) - p(x_0, y_{S+1}, t_{j-1})\} \end{aligned} \quad \text{Equation 2}$$

where x and y are respective spatial axes, t is a time, v is an air particle velocity, p is a sound pressure, a and b are coefficients, and $\theta_x$ and $\theta_y$ are directions of a sound source.

10. The microphone array system according to claim 9, wherein a distance between the microphones is not more than a value shown in Equation 4, $$x_{i+1} - x_i = \frac{c}{F_s} \quad \text{Equation 4}$$

where c is a sound velocity, and $F_s$ is a sampling frequency.

11. The microphone array system according to claim 9, comprising a synchronous adding part, wherein the sound signal estimation processing part executes the sound signal estimation processing with respect to a plurality of positions, and the synchronous adding part adds obtained sound signal estimation results synchronously, whereby the microphone array system performs processing for enhancing a desired sound of the sound source.

12. The microphone array system according to claim 9, comprising a synchronous subtracting part, wherein the sound signal estimation processing part executes the sound signal estimation processing with respect to a plurality of positions, and the synchronous subtracting part subtracts obtained sound signal estimation results synchronously, whereby the microphone array system performs processing for suppressing noise by subtracting sound signals coming from the sound source.

13. The microphone array system according to claim 9, comprising a part for calculating a cross-correlation coefficient and a part for detecting a position of a sound source, wherein the sound signal estimation processing part executes the sound signal estimation processing with respect to a plurality of positions, the part for calculating a cross-correlation coefficient performs processing for calculating cross-correlation coefficients of obtained sound signal estimation results, and the part for detecting a position of a sound source performs processing for detecting the position of the sound source by comparing coefficients based on the cross-correlation coefficient calculation results.

14. The microphone array system according to claim 11, wherein the microphones are directional microphones, and the microphone array system comprises stereo sound input processing with the directional microphones and the processing for enhancing a desired sound.

15. The microphone array system according to claim 14, comprising a movable camera and a part for detecting a distance to a sound source, wherein the part for detecting a distance to a sound source switches the processing for enhancing a desired sound in an imaging direction of the movable camera and the stereo sound input processing, based on the distance to the sound source detected by the part for detecting a distance to a sound source, and executes the selected processing.

16. The microphone array system according to claim 12, comprising a part for calculating a cross-correlation coefficient and a part for detecting a position of a sound source, wherein the part for calculating a cross-correlation coefficient calculates cross-correlation coefficients based on sound signals received by the microphones, the part for detecting a position of a sound source detects the number of noise sources based on the cross-correlation coefficient calculation results, the sound signal estimation processing part determines the number of positions for estimation of sound signals based on the detected number of noise sources and executes the sound signal estimation processing, and the synchronous subtracting part subtracts obtained sound signal estimation results synchronously, whereby the microphone array system performs processing for suppressing noise by subtracting sound signals coming from the noise sources.

17. A microphone array system comprising four microphones that are not on a same plane and a sound signal estimation processing part, which estimates a sound signal to be received in an arbitrary position in a space, wherein the sound signal estimation processing part expresses a estimated sound signal to be received in an arbitrary position in a space by a wave equation Equation 3, assuming that a sound wave coming from a sound source to the four microphones is a plane wave, the sound signal estimation processing part estimates coefficients b cos $\theta_x$, b cos $\theta_y$ and b cos $\theta_z$ of the wave equation Equation 3 that depend on a direction from which a sound wave comes, assuming that an average power of the sound wave that reaches each of the four microphones is equal to those of the other microphones, and the sound signal estimation processing part estimates a sound signal to be received in an arbitrary position in the space in which the microphones are arranged, based on sound signals received by the four microphones, $$\begin{aligned}
&P(x_{i+1}, y_0, z_0, t_j) - P(x_i, y_0, z_0, t_j) = \\
&\qquad a\{v_x(x_i, y_0, z_0, t_{j+1}) - v_x(x_i, y_0, z_0, t_j)\} \\
&\{v_x(x_{i+1}, y_0, z_0, t_j) - v_x(x_i, y_0, z_0, t_j)\} = \\
&\qquad b\cos\theta_x\{p(x_{i+1}, y_0, z_0, t_j) - p(x_{i+1}, y_0, z_0, t_{j-1})\} \\
&P(x_0, y_{S+1}, z_0, t_j) - P(x_0, y_S, z_0, t_j) = \\
&\qquad a\{v_y(x_0, y_S, z_0, t_{j+1}) - v_y(x_0, y_S, z_0, t_j)\} \\
&\{v_y(x_0, y_{S+1}, z_0, t_j) - v_y(x_0, y_S, z_0, t_j)\} = \\
&\qquad b\cos\theta_y\{p(x_0, y_{S+1}, z_0, t_j) - p(x_0, y_{S+1}, z_0, t_{j-1})\} \\
&P(x_0, y_0, z_{R+1}, t_j) - P(x_0, y_0, z_R, t_j) = \\
&\qquad a\{v_Z(x_0, y_0, z_R, t_{j+1}) - v_z(x_0, y_0, z_R, t_j)\} \\
&\{v_Z(x_0, y_0, z_{R+1}, t_j) - v_Z(x_0, y_0, z_R, t_j)\} = \\
&\qquad b\cos\theta_Z\{p(x_0, y_0, z_{R+1}, t_j) - p(x_0, y_0, z_{R+1}, t_{j-1})\}
\end{aligned} \qquad \text{Equation 3}$$

where x, y, and z are respective spatial axes, t is a time, v is a air particle velocity, p is a sound pressure, a and b are coefficients, and $\theta_x$, $\theta_y$ and $\theta_z$ are directions of a sound source.

18. The microphone array system according to claim 17, wherein a distance between the microphones is not more than a value shown in Equation 4, $$x_{i+1} - x_i = \frac{c}{F_s} \qquad \text{Equation 4}$$

where c is a sound velocity, and $F_s$ is a sampling frequency.

19. The microphone array system according to claim 17, comprising a synchronous adding part, wherein the sound signal estimation processing part executes the sound signal estimation processing with respect to a plurality of positions, and the synchronous adding part adds obtained sound signal estimation results synchronously, whereby the microphone array system performs processing for enhancing a desired sound of the sound source.

20. The microphone array system according to claim 17, comprising a synchronous subtracting part, wherein the sound signal estimation processing part executes the sound signal estimation processing with respect to a plurality of positions, and the synchronous subtracting part subtracts obtained sound signal estimation results synchronously, whereby the microphone array system performs processing for suppressing noise by subtracting sound signals coming from the sound source.

21. The microphone array system according to claim 17, comprising a part for calculating a cross-correlation coefficient and a part for detecting a position of a sound source, wherein the sound signal estimation processing part executes the sound signal estimation processing with respect to a plurality of positions, the part for calculating a cross-correlation coefficient performs processing for calculating cross-correlation coefficients of obtained sound signal estimation results, and the part for detecting a position of a sound source performs processing for detecting the position of the sound source by comparing coefficients based on the cross-correlation coefficient calculation results.

22. The microphone array system according to claim 19, wherein the microphones are directional microphones, and the microphone array system comprises stereo sound input processing with the directional microphones and the processing for enhancing a desired sound.

23. The microphone array system according to claim 22, comprising a movable camera and a part for detecting a distance to a sound source, wherein the part for detecting a distance to a sound source switches the processing for enhancing a desired sound in an imaging direction of the movable camera and the stereo sound input processing, based on the distance to the sound source detected by the part for detecting a distance to a sound source, and executes the selected processing.

24. The microphone array system according to claim 20, comprising a part for calculating a cross-correlation coefficient and a part for detecting a position of a sound source, wherein the part for calculating a cross-correlation coefficient calculates cross-correlation coefficients based on sound signals received by the microphones, the part for detecting a position of a sound source detects the number of noise sources based on the cross-correlation coefficient calculation results, the sound signal estimation processing part determines the number of positions for estimation of sound signals based on the detected number of noise sources and executes the sound signal estimation processing, and the synchronous subtracting part subtracts obtained sound signal estimation results synchronously, whereby the microphone array system performs processing for suppressing noise by subtracting sound signals coming from the noise sources.

25. A microphone array system comprising two microphones and a sound signal estimation processing part, which estimates a sound signal to be received in an arbitrary position on a straight line on which the two microphones are arranged, wherein the sound signal estimation processing part expresses a estimated sound signal to be received in a position on the straight line on which the two microphones are arranged by a wave equation Equation 1, assuming that a sound wave coming from a sound source to the two microphones is a plane wave, the sound signal estimation processing part estimates a coefficient b cos θ of the wave equation Equation 1 that depends on a direction from which a sound wave comes, assuming that an average power of the sound wave that reaches each of the two microphones is equal to that of the other microphone, and the sound signal estimation processing part estimates a sound signal to be received in an arbitrary position on a same axis on which the microphones are arranged, based on sound signals received by the two microphones, $$P(x_{i+1}, y_0, t_j) - P(x_i, y_0, t_j) = a\{v_x(x_i, y_0, t_{j+1}) - v_x(x_i, y_0, t_j)\} \qquad \text{Equation 1}$$

$$\{v_x(x_{i+1}, y_0, t_j) - v_x(x_i, y_0, t_j)\} = b\cos\theta\{p(x_{i+1}, y_0, t_j) - p(x_{i+1}, y_0, t_{j-1})\}$$

where x and y are respective spatial axes, t is a time, v is a air particle velocity, p is a sound pressure, a and b are coefficients, and θ is a direction of a sound source, wherein the microphone array system executes a combination of at least one kind of signal processing selected from the group consisting of processing for enhancing a desired sound, processing for suppressing noise, and processing for detecting a position of a sound source, the processing for enhancing a desired sound is performed by the microphone array system further comprising a synchronous adding part, wherein the sound signal estimation processing part executes the sound signal estimation processing with respect to a plurality of positions, and the synchronous adding part adds obtained sound signal estimation results synchronously, whereby performs processing for enhancing a desired sound of the sound source, the processing for suppressing noise is performed by the microphone array system further comprising a synchronous subtracting part, wherein the sound signal estimation processing part executes the sound signal estimation processing with respect to a plurality of positions, and the synchronous subtracting part subtracts obtained sound signal estimation results synchronously, whereby the microphone array system performs processing for suppressing noise by subtracting sound signals coming from the sound source, and the processing for detecting a position of a sound source is performed by the microphone array system further comprising a part for calculating a cross-correlation coefficient and a part for detecting a position of a sound source, wherein the sound signal estimation processing part executes the sound signal estimation processing with respect to a plurality of positions, the part for calculating a cross-correlation coefficient performs processing for calculating cross-correlation coefficients of obtained sound signal estimation results, and the part for detecting a position of a sound source performs processing for detecting the position of the sound source by comparing coefficients based on the cross-correlation coefficient calculation results.

26. A microphone array system comprising three microphones that are not on a same straight line and a sound signal estimation processing part, which estimates a sound signal to be received in an arbitrary position on a same plane on which the three microphones are arranged, wherein the sound signal estimation processing part expresses a estimated sound signal to be received in a position on the same plane on which the three microphones are arranged by a wave equation Equation 2, assuming that a sound wave coming from a sound source to the three microphones is a plane wave, the sound signal estimation processing part estimates coefficients b cos $\theta_x$ and b cos $\theta_y$ of the wave equation Equation 2 that depend on a direction from which a sound wave comes, assuming that an average power of the sound wave that reaches each of the three microphones is equal to those of the other microphones, and the sound signal estimation processing part estimates a sound signal to be received in an arbitrary position on the same plane on which the microphones are arranged, based on sound signals received by the three microphones, $$P(x_{i+1}, y_0, t_j) - P(x_i, y_0, t_j) = a\{v_x(x_i, y_0, t_{j+1}) - v_x(x_i, y_0, t_j)\} \quad \text{Equation 2}$$

$$\{v_x(x_{i+1}, y_0, t_j) - v_x(x_i, y_0, t_j)\} = b\cos\theta_x\{p(x_{i+1}, y_0, t_j) - p(x_{i+1}, y_0, t_{j-1})\}$$

$$P(x_0, y_{S+1}, t_j) - P(x_0, y_S, t_j) = a\{v_y(x_0, y_S, t_{j+1}) - v_y(x_0, y_S, t_j)\}$$

$$\{v_y(x_0, y_{S+1}, t_j) - v_y(x_0, y_S, t_j)\} = b\cos\theta_y\{p(x_0, y_{S+1}, t_j) - p(x_0, y_{S+1}, t_{j-1})\}$$

where x and y are respective spatial axes, t is a time, v is an air particle velocity, p is a sound pressure, a and b are coefficients, and $\theta_x$ and $\theta_y$ are directions of a sound source, wherein the microphone array system executes a combination of at least one kind of signal processing selected from the group consisting of processing for enhancing a desired sound, processing for suppressing noise, and processing for detecting a position of a sound source, the processing for enhancing a desired sound is performed by the microphone array system further comprising a synchronous adding part, wherein the sound signal estimation processing part executes the sound signal estimation processing with respect to a plurality of positions, and the synchronous adding part adds obtained sound signal estimation results synchronously, whereby performs processing for enhancing a desired sound of the sound source, the processing for suppressing noise is performed by the microphone array system further comprising a synchronous subtracting part, wherein the sound signal estimation processing part executes the sound signal estimation processing with respect to a plurality of positions, and the synchronous subtracting part subtracts obtained sound signal estimation results synchronously, whereby the microphone array system performs processing for suppressing noise by subtracting sound signals coming from the sound source, and the processing for detecting a position of a sound source is performed by the microphone array system further comprising a part for calculating a cross-correlation coefficient and a part for detecting a position of a sound source, wherein the sound signal estimation processing part executes the sound signal estimation processing with respect to a plurality of positions, the part for calculating a cross-correlation coefficient performs processing for calculating cross-correlation coefficients of obtained sound signal estimation results, and the part for detecting a position of a sound source performs processing for detecting the position of the sound source by comparing coefficients based on the cross-correlation coefficient calculation results.

27. A microphone array system comprising four microphones that are not on a same plane and a sound signal estimation processing part, which estimates a sound signal to be received in an arbitrary position in a space, wherein the sound signal estimation processing part expresses a estimated sound signal to be received in an arbitrary position in a space by a wave equation Equation 3, assuming that a sound wave coming from a sound source to the four microphones is a plane wave, the sound signal estimation processing part estimates coefficients b cos $\theta_x$, b cos $\theta_y$ and b cos $\theta_z$ of the wave equation Equation 3 that depend on a direction from which a sound wave comes, assuming that an average power of the sound wave that reaches each of the four microphones is equal to those of the other microphones, and the sound signal estimation processing part estimates a sound signal to be received in an arbitrary position in the space in which the microphones are arranged, based on sound signals received by the four microphones, $$P(x_{i+1}, y_0, z_0, t_j) - P(x_i, y_0, z_0, t_j) = a\{v_x(x_i, y_0, z_0, t_{j+1}) - v_x(x_i, y_0, z_0, t_j)\} \quad \text{Equation 3}$$

$$\{v_x(x_{i+1}, y_0, z_0, t_j) - v_x(x_i, y_0, z_0, t_j)\} = b\cos\theta_x\{p(x_{i+1}, y_0, z_0, t_j) - p(x_{i+1}, y_0, z_0, t_{j-1})\}$$

$$P(x_0, y_{S+1}, z_0, t_j) - P(x_0, y_S, z_0, t_j) = a\{v_y(x_0, y_S, z_0, t_{j+1}) - v_y(x_0, y_S, z_0, t_j)\}$$

$$\{v_y(x_0, y_{S+1}, z_0, t_j) - v_y(x_0, y_S, z_0, t_j)\} = b\cos\theta_y\{p(x_0, y_{S+1}, z_0, t_j) - p(x_0, y_{S+1}, z_0, t_{j-1})\}$$

$$P(x_0, y_0, z_{R+1}, t_j) - P(x_0, y_0, z_R, t_j) = a\{v_Z(x_0, y_0, z_R, t_{j+1}) - v_z(x_0, y_0, z_R, t_j)\}$$

$$\{v_Z(x_0, y_0, z_{R+1}, t_j) - v_Z(x_0, y_0, z_R, t_j)\} = b\cos\theta_Z\{p(x_0, y_0, z_{R+1}, t_j) - p(x_0, y_0, z_{R+1}, t_{j-1})\}$$

where x, y, and z are respective spatial axes, t is a time, v is a air particle velocity, p is a sound pressure, a and b are coefficients, and $\theta_x$, $\theta_y$ and $\theta_z$ are directions of a sound source, wherein the microphone array system executes a combination of at least one kind of signal processing selected from the group consisting of processing for enhancing a desired sound, processing for suppressing noise, and processing for detecting a position of a sound source, the processing for enhancing a desired sound is performed by the microphone array system further comprising a synchronous adding part, wherein the sound signal estimation processing part executes the sound signal estimation processing with respect to a plurality of positions, and the synchronous adding part adds obtained sound signal estimation results synchronously, whereby performs processing for enhancing a desired sound of the sound source, the processing for suppressing noise is performed by the microphone array system further comprising a synchronous subtracting part, wherein the sound signal estimation processing part executes the sound signal estimation processing with respect to a plurality of positions, and the synchronous subtracting part subtracts obtained sound signal estimation results synchronously, whereby the microphone array system performs processing for suppressing noise by subtracting sound signals coming from the sound source, and the processing for detecting a position of a sound source is performed by the microphone array system further comprising a part for calculating a cross-correlation coefficient and a part for detecting a position of a sound source, wherein the sound signal estimation processing part executes the sound signal estimation processing with respect to a plurality of positions, the part for calculating a cross-correlation coefficient performs processing for calculating cross-correlation coefficients of obtained sound signal estimation results, and the part for detecting a position of a sound source performs processing for detecting the position of the sound source by comparing coefficients based on the cross-correlation coefficient calculation results.

* * * * *